US011519657B1

(12) United States Patent
Sever et al.

(10) Patent No.: US 11,519,657 B1
(45) **Date of Patent: *Dec. 6, 2022**

(54) DRY ICE CONTAINING SHIPPERS

(71) Applicant: Praxair Technology, Inc., Danbury, CT (US)

(72) Inventors: Robert R. Sever, Northbrook, IL (US); Ying Zhou, Naperville, IL (US); Ranko Bursac, Libertyville, IL (US); Amitabh Gupta, Naperville, IL (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/485,974

(22) Filed: Sep. 27, 2021

(51) Int. Cl.
*F25D 3/14* (2006.01)
*F25D 23/06* (2006.01)

(52) U.S. Cl.
CPC ..... *F25D 3/14* (2013.01); *F25D 23/06* (2013.01); *F25D 2201/10* (2013.01)

(58) Field of Classification Search
CPC . F25D 3/14; F25D 29/003; F25D 3/12; F25D 3/122; F25D 3/105; F25D 3/06
See application file for complete search history.

(56) References Cited

U.S. PATENT DOCUMENTS

| | | | | |
|---|---|---|---|---|
| 2,325,371 | A | 7/1943 | Clerc | |
| 4,576,017 | A | 3/1986 | Combs et al. | |
| 5,363,670 | A * | 11/1994 | Bartilucci | F25D 3/12 62/166 |
| 5,417,082 | A | 5/1995 | Foster et al. | |
| 8,151,599 | B2 | 4/2012 | Sixt | |
| 2010/0000250 | A1 | 1/2010 | Sixt | |
| 2012/0197810 | A1 | 8/2012 | Haarmann et al. | |
| 2018/0216864 | A1 | 8/2018 | Pitsinki et al. | |

FOREIGN PATENT DOCUMENTS

| | | | |
|---|---|---|---|
| FR | 2952709 | A1 | 5/2011 |
| NL | 2021117 | B1 | 12/2019 |
| WO | 2007049380 | A1 | 5/2007 |
| WO | 2011061431 | A1 | 5/2011 |

OTHER PUBLICATIONS

Yi Zhao et al., Application and research progress of cold storage technology in cold chain transportation and distribution, Journal of Thermal Analysis and Calorimetry (2020) 139:1419-1434, Jun. 14, 2019, Springer.

Gary Burgess, Practical Thermal Resistance and Ice Requirement Calculations for Insulating Packages, Packaging Technology and Science, Packag. Technol. Sci. 12, 75-80 (1999), John Wiley & Sons, Ltd.

(Continued)

*Primary Examiner* — Brian M King
(74) *Attorney, Agent, or Firm* — Nilay S. Dalal

(57) ABSTRACT

Dry ice shippers with unique structural features designed to deliver optimized performance for preserving one or more perishable items in a presence of dry ice during transport are provided. The improved dry ice shippers exhibit superior properties that overcome the performance limitations of conventional dry ice shippers.

10 Claims, 5 Drawing Sheets

(56) References Cited

OTHER PUBLICATIONS

Jay Singh, et al., The Effect of Distribution on Product Temperature Profile in Thermally Insulated Containers for Express Shipments, Packaging Technology and Science. 26(6) p. 327-338. Oct. 2013.
Iurii Konovalenko, et al., Real-time temperature prediction in a cold supply chain based on Newton's law of cooling, Decision Support Systems, 2021, Elsevier.
Charles J. Hunt, Technical Considerations in the Freezing, Low-Temperature Storage and Thawing of Stem Cells for Cellular Therapies, Transfusion Medicine and Hemotherapy, 2019, Mar. 28, 2019, karger.com.
Bin LI, et al., Temperature Distribution in Insulated Temperature-Controlled Container by Numerical Simulation, Energies, 2020, Sep. 12, 2020, mdpi.com.
Kazuhisa Matsunaga, et al., Two Methods for Calculating the Amount of Refrigerant Required for Cyclic Temperature Testing of Insulated Packages, Packaging Technology and Science, Packag. Technol. Sci. 2007; 20: 113-123, Aug. 25, 2006 in Wiley InterScience (www.interscience.wiley.com).
P. Rooney, et al., Validation of cold chain shipping environment for transport of allografts as part of a human tissue bank returns policy, Cell Tissue Bank (2015) 16:553-558, Feb. 21, 2015, Springer Science+Business Media Dordrecht 2015.

* cited by examiner

DRY ICE CONTAINING SHIPPERS

FIELD OF INVENTION

This invention relates to transportable dry ice shippers for preserving one or more perishable items during transport in a presence of dry ice. In particular, this invention relates to dry ice shippers with improved properties that overcome the performance limitations of conventional dry ice shippers.

BACKGROUND OF THE INVENTION

A wide variety of perishable items are required to be preserved in a frozen state to ensure they have adequate stability for their intended applications. These perishable items include, but are not limited to, biological materials typically utilized in life science and healthcare fields, such as pharmaceuticals, biospecimens, tissue-based therapies and reproductive cells.

A common means of transporting frozen biological materials from one location to another is to place the frozen biological materials in an insulated shipping container with dry ice (hereinafter, referred to interchangeably as either a "dry ice shipper" or "shipper"). Dry ice is a solid form of carbon dioxide and has a temperature of approximately −78.5° C. at atmospheric pressure.

Unfortunately, today's commercially available dry ice shippers do not exhibit reliable performance required for effective storage and transport of frozen biological materials in all desired use scenarios. Many conventional dry ice shippers are not capable of maintaining sufficient cooling duration during transport. Biological materials are temperature sensitive items that can degrade if they are not kept sufficiently cold. Inadequate or shortened refrigeration time can lead to damage of the biological materials.

Given the importance to preserve quality and structural integrity of biological materials, there is an unmet need for improved dry ice shippers designed to preserve biological materials as well as other frozen perishable items in the presence of dry ice and enable transport of those items from one location to another location.

SUMMARY OF THE INVENTION

In one aspect, an improved dry ice containing apparatus, comprising: a transportable shipper with a contents region volume, said contents region volume at least partially defined by shipper walls surrounding therealong, said contents region volume apportioned between a first portion for holding dry ice and a second portion for holding one or more perishable items; the dry ice occupying the first portion of the contents region volume; the one or more perishable items occupying the second portion of the contents region volume; one or more openings extending into the shipper walls, each of said one or more openings in fluid communication with the contents region volume to allow the dry ice and the one or more perishable items to be introduced thereinto and removed therefrom; one or more corresponding insulated plugs to substantially close the one or more openings; the improved dry ice containing apparatus comprising an insulative structural element, said insulative structural element encapsulating the contents region volume and configured to reduce heat ingress from a surrounding environment into the contents region volume to create an overall heat transfer coefficient designated as (U) and having a value that is less than about 0.5 kJ/hr/m$^2$/° C., but greater than 0, wherein the overall heat transfer coefficient (U) is determined under a condition where each of the one or more openings is substantially closed by the one or more corresponding insulated plugs.

In a second aspect, an improved dry ice containing apparatus, comprising: a transportable shipper with a contents region volume, said contents region volume at least partially defined by insulative shipper walls that surround the contents region volume, said contents region volume apportioned between a first portion for holding dry ice and a second portion for holding one or more perishable items; the dry ice occupying the first portion of the contents region volume; the one or more perishable items occupying the second portion of the contents region volume; the improved dry ice containing apparatus further characterized by a loading ratio designated as (R), wherein the loading ratio (R) is defined as the ratio of the first portion of the contents region volume for holding the dry ice and having a volume of $V_D$ to the second portion of contents region volume for holding the one or more perishable items and having a volume of $V_1$, wherein the loading ratio (R) has a value of 4 or less, but greater than 0.

In a third aspect, an improved dry ice containing apparatus, comprising: a transportable shipper with a contents region volume, said contents region volume at least partially defined by insulative shipper walls that surround the contents region volume, said contents region volume apportioned between a first portion adapted for holding dry ice and a second portion adapted for holding one or more perishable items; one or more openings extending into the insulative shipper walls, each of said one or more openings in fluid communication with the contents region volume; said transportable shipper exhibiting heat channel characteristics that are structurally defined by a total heat channel seam length designated as ($L_T$), wherein the total heat channel seam length ($L_T$) is equal to a sum of a total insulation heat channel seam length ($L_{ins}$) and a total opening heat channel seam length ($L_{open}$); the improved dry ice containing apparatus further parameterized by a normalized total heat channel seam length designated as ($L_N$) and having a value of ($L_T/L_S$), where ($L_S$) is a sum of lengths of three primary external dimensions of the improved dry ice containing apparatus, wherein ($L_N$) has a value that is 0.6 or less, but greater than 0.

In a fourth aspect, an improved dry ice containing apparatus, comprising: a transportable shipper with a contents region volume, said contents region volume surrounded by insulative shipper walls; wherein the contents region volume contains all of the available locations for placement of dry ice and one or more perishable items; the dry ice occupying a portion of the contents region volume; one or more openings in the surrounding insulative shipper walls through which (i) the dry ice can be loaded into and removed from the contents region volume, and (ii) the one or more perishable items can be loaded into or removed from the contents region volume; one or more corresponding insulated plugs to substantially close off the one or more openings; wherein all of the available locations within the contents region volume are maintained at or below −60 degrees Celsius when 2-50 vol % of the contents region volume contains the dry ice, as determined under a condition when each of the one or more openings are substantially closed by the one or more corresponding insulated plugs.

In a fifth aspect, an improved dry ice containing apparatus exhibiting temperature uniformity, comprising: a transportable shipper with a contents region volume, said contents region volume surrounded by insulative shipper walls; the contents region volume containing substantially all of the available locations for placement of the dry ice and one or more perishable items; the dry ice occupying a portion of the contents region volume; one or more openings extending into the insulative shipper walls, each of said one or more openings in fluid communication with the contents region volume to allow the dry ice and the one or more perishable items to be introduced thereinto and removed therefrom; one or more corresponding insulated plugs to substantially close the one or more openings; wherein the largest temperature difference in all of the available locations is less than 10 degrees Celsius when 5-60 vol % of the contents region volume is occupied with the dry ice as determined under a condition when each of the one or more openings are substantially closed by the one or more corresponding insulated plugs.

In a sixth aspect, an improved dry ice containing apparatus, comprising: a transportable shipper with a contents region volume, said contents region volume at least partially defined by insulative shipper walls surrounding therealong, said contents region volume having a first portion adapted for holding dry ice and a second portion adapted for holding one or more perishable items; the dry ice contained in the first portion of the contents region volume; one or more openings extending into the insulated shipper walls, each of said one or more openings in fluid communication with contents region volume to allow the dry ice and the one or more perishable items to be introduced into and removed from each of said one or more openings; the improved dry ice containing apparatus comprising an insulative structural element, said insulative structural element encapsulating the contents region volume and configured to reduce heat ingress from a surrounding environment into the contents region to create an overall heat transfer coefficient designated as (U) and having a value that is 1 kJ/hr/m$^2$/° C. or less, but greater than 0, wherein said value of the overall heat transfer coefficient (U) is determined under a condition where each of said one or more openings of the shipper is exposed to a surrounding environment.

In a seventh aspect, an improved dry ice containing apparatus, comprising: a transportable shipper with a contents region volume, said contents region volume surrounded by insulative shipper walls; wherein the contents region volume contains all of the available locations for placement of dry ice and one or more perishable items; the dry ice occupying a portion of the contents region volume in an initial amount of greater than 10 vol % of the contents region volume; one or more openings in the surrounding insulative shipper walls through which (i) the dry ice can be loaded into and removed from the contents region volume, and (ii) the one or more perishable items can be loaded into or removed from the contents region volume; one or more corresponding insulated plugs substantially closing off the one or more openings; the insulative shipper walls encapsulating the contents region volume and configured to maintain an average rate of change of the temperature at any location in the contents region volume between zero and 0.05° C./% as the dry ice sublimates in the contents region volume from an initial amount occupying up to about 80 vol % to a final amount occupying a percentage of the contents region volume less than the initial amount and no less than about 10 vol % of the contents region volume.

In an eight aspect, an improved dry ice containing apparatus, comprising: a transportable shipper with a contents region volume, said contents region volume surrounded by insulative shipper walls; wherein the contents region volume contains all of the available locations for placement of dry ice and one or more perishable items; the dry ice occupying a portion of the contents region volume in an initial amount of greater than 10 vol % of the contents region volume; one or more openings in the surrounding insulative shipper walls through which (i) the dry ice can be loaded into and removed from the contents region volume, and (ii) the one or more perishable items can be loaded into or removed from the contents region volume; one or more corresponding insulated plugs substantially closing off the one or more openings; the insulative shipper walls encapsulating the contents region volume and configured to maintain an average rate of change of the warmest temperature measured in the contents region volume between zero and 0.05° C./% as the dry ice sublimates in the contents region volume from an initial amount occupying up to about 80 vol % to a final amount occupying a percentage of the contents region volume less than the initial amount and no less than about 10 vol % of the contents region volume.

In a ninth aspect, an improved dry ice containing apparatus, comprising: a transportable shipper with a contents region volume, said contents region volume at least partially defined by shipper walls surrounding therealong, said contents region volume apportioned between a first portion for holding dry ice and a second portion for holding one or more perishable items; the dry ice occupying the first portion of the contents region volume; the one or more perishable items occupying the second portion of the contents region volume; one or more openings extending into the shipper walls, each of said one or more openings in fluid communication with the contents region volume to allow dry ice and the one or more perishable items to be introduced thereinto and removed therefrom; one or more corresponding insulated plugs to substantially close the one or more openings; the improved dry ice containing apparatus comprising an insulative structural element, said insulative structural element encapsulating the contents region volume and configured to reduce heat ingress from a surrounding environment into the contents region volume to create a loading ratio overall heat transfer coefficient designated as ($U_R$) and having a value that is less than about 2 kJ/hr/m$^2$/° C., but greater than 0, wherein the loading ratio overall heat transfer coefficient ($U_R$) is determined under a condition where each of the one or more openings is substantially closed by the one or more corresponding insulated plugs.

In a tenth aspect, an improved dry ice containing apparatus, comprising: a transportable shipper with a contents region volume, said contents region volume at least partially defined by shipper walls surrounding therealong, said contents region volume apportioned between a first portion for holding dry ice and a second portion for holding one or more perishable items; the dry ice occupying the first portion of the contents region volume; the one or more perishable items occupying the second portion of the contents region volume; one or more openings extending into the shipper walls, each of said one or more openings in fluid communication with the contents region volume to allow dry ice and the one or more perishable items to be introduced thereinto and removed therefrom; the improved dry ice containing apparatus comprising an insulative structural element, said insulative structural element encapsulating the contents region volume and configured to reduce heat ingress from a surrounding environment into the contents region volume to create a loading ratio overall heat transfer coefficient designated as ($U_R$) and having a value that is less than about 4 kJ/hr/m$^2$/° C., but greater than 0, wherein said value of the loading ratio overall heat transfer coefficient ($U_R$) is determined under a condition where each of said one or more openings of the shipper is exposed to a surrounding environment.

In an eleventh aspect, an improved dry ice containing apparatus, comprising: a transportable shipper with a contents region volume, said contents region volume at least partially defined by insulative shipper walls that surround the contents region volume, said contents region volume apportioned between a first portion adapted for holding dry ice and a second portion adapted for holding one or more perishable items; whereby the transportable shipper exhibits heat channel characteristics to define a total heat channel seam length that is structurally configured to create a normalized loading ratio heat channel factor designated as (F) having a value that is 1.5 or less, but greater than 0.

In a twelfth aspect, an improved dry ice containing apparatus, comprising: a transportable shipper with a contents region volume, said contents region volume surrounded by insulative shipper walls; wherein the contents region volume contains all of the available locations for placement of dry ice and one or more perishable items; the dry ice occupying a portion of the contents region volume in an initial amount of greater than 10 vol % of the contents region volume; one or more openings in the surrounding insulative shipper walls through which (i) the dry ice can be loaded into and removed from the contents region volume, and (ii) the one or more perishable items can be loaded into or removed from the contents region volume; one or more corresponding insulated plugs substantially closing off the one or more openings; the insulative shipper walls encapsulating the contents region volume and configured to maintain an average rate of change of the largest temperature difference in the contents region volume between zero and 0.05° C./% as the dry ice sublimates in the contents region volume from the initial amount occupying up to about 80 vol % to a final amount occupying a percentage of the contents region volume less than the initial amount and no less than about 10 vol % of the contents region volume.

In a thirteenth aspect, an improved dry ice containing apparatus, comprising: a transportable shipper with a contents region volume, said contents region volume surrounded by insulative shipper walls; wherein the contents region volume contains all of the available locations for placement of dry ice and one or more perishable items; the dry ice occupying a portion of the contents region volume; one or more openings in the surrounding insulative shipper walls through which (i) the dry ice can be loaded into and removed from the contents region volume, and (ii) the one or more perishable items can be loaded into or removed from the contents region volume; one or more corresponding insulated plugs to substantially close off the one or more openings; wherein all of the available locations within the contents region volume are maintained at or below −70 degrees Celsius when 10-70 vol % of the contents region volume contains the dry ice, as determined under a condition when each of the one or more openings are substantially closed by the one or more corresponding insulated plugs.

DETAILED DESCRIPTION OF THE INVENTION

Figure 1:
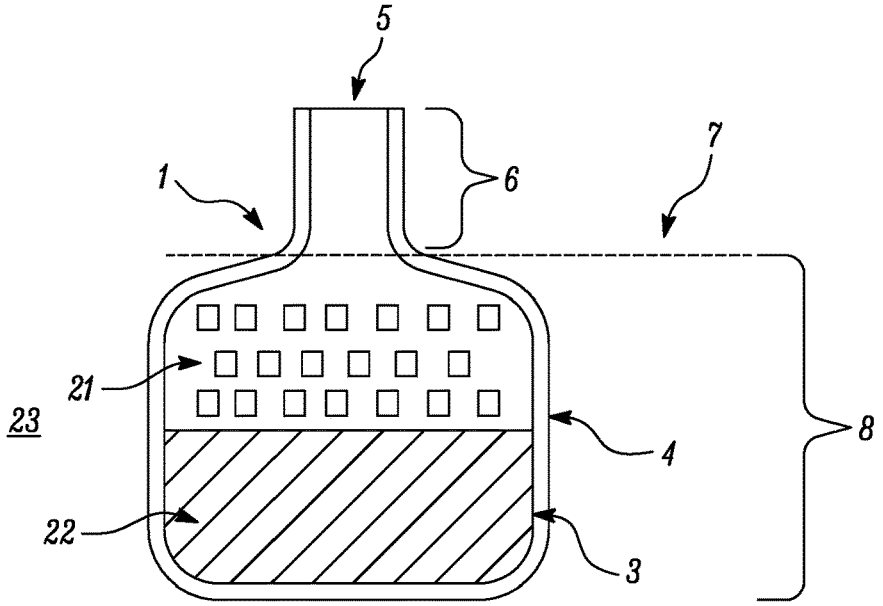
FIG. 1 illustrates a representative schematic of a dry ice shipper in accordance with the principles of the present invention in which the contents region volume is occupied with a predetermined amount of dry ice and perishable items.

It should be understood that "dry ice" herein and throughout means particles (i.e., nuggets, pellets and the like) or blocks of solidified carbon dioxide, whereby the particles or blocks can be of any size.

"Perishable item" as used herein and throughout means any temperature-sensitive items, goods, samples, products or supplies which may be susceptible to spoilage, degradation, and/or structural alteration or modification if not maintained frozen or below a certain temperature, including, but not limited to, biological materials and samples, such as blood, urine and tissue samples or their constituents; perishable foods, such as meat, poultry, fish and dairy products; personal care items; and chemicals.

"Contents region volume" means the space within the dry ice shipper that is capable of receiving one or more perishable items and a predetermined amount of dry ice.

"Charging" or "filling" or "introducing" or "loading" or "feeding," any of which may be used interchangeably herein and throughout, means the process of introducing dry ice into a dry ice shipper, whereby the dry ice can be manually or automatically introduced into the dry ice shipper.

"Dry ice shipper" or "shipper," both of which may be used interchangeably herein and throughout, is intended to mean a specially designed container that is capable of receiving dry ice and one or more perishable items for transport.

"Transport" or "transportability" or "transportable" as used herein and throughout means an apparatus that is transported or shipped from a first location (e.g., user location) to a second location (e.g., intermediate or final destination) by any known means, including, but not limited to, air, ground or water. The transport or shipping can occur through various packaged delivery services, including, but not limited to, parcel post, UPS® shipping services, FedEx® shipping services and the like.

The relationship and functioning of the various elements of the embodiments are better understood by the following detailed description. The detailed description contemplates the features, aspects and embodiments in various permutations and combinations, as being within the scope of the disclosure. The disclosure may therefore be specified as comprising, consisting or consisting essentially of, any of such combinations and permutations of these specific features, aspects, and embodiments, or a selected one or ones thereof.

Where a range of values describes a parameter, all sub-ranges, point values and endpoints within that range or defining a range are explicitly disclosed therein. All physical properties, parameters, dimensions, and ratio ranges and sub-ranges (including endpoints) between range end points for those properties, parameters, dimensions, and ratios are considered explicitly disclosed herein.

The drawings are for the purpose of illustrating the invention and are not intended to be drawn to scale. The embodiments are described with reference to the drawings in which similar elements are referred to by like numerals. Certain features are intentionally omitted in each of the drawings to better illustrate various aspects of the dry ice shippers, in accordance with the principles of the present invention. The embodiments as described below are by way of example only, and the invention is not limited to the embodiments illustrated in the drawings.

Dry ice shippers must be reliable in several ways. Frozen perishable items conveyed in a dry ice shipper have an upper temperature limit below which they need to be maintained to ensure their quality and/or structural integrity. Unfortunately, many commercially available dry ice shippers cannot maintain sufficient cooling duration with a reasonable quantity of dry ice and available payload volume. To compensate for poor cooling duration and meet transport requirements, the dry ice shippers utilize too much dry ice, thereby compromising the available payload space for storage of the perishable items. Additionally, introducing too much dry ice to overcome shorter cooling duration can increase the size, weight and shipping costs for the dry ice shippers. The increased weight of the dry ice shipper can also potentially lead to ergonomic difficulties, including difficulties with transportability of the shipper.

In other instances, commercially available dry ice shippers can exhibit poor temperature control, in which significant temperature gradients can arise within the shipper storage zone that fall outside the prescribed temperature range of the frozen biological materials. Additionally, commercially available dry ice shippers suffer from increased temperature variation as dry ice sublimates. The normal sublimation temperature of dry ice at atmospheric pressure is approximately −78.5° C. The sublimation phase change of carbon dioxide from solid to gas is an endothermic process. As a result, one portion of dry ice inside a dry ice shipper can potentially sub-cool below its equilibrium sublimation temperature as another portion of the dry ice is absorbing heat and sublimating. As a result, regions of a dry ice shipper's internal volume that are directly adjacent to dry ice may have temperatures at or below the normal sublimation temperature. Other regions of a dry ice shipper's internal volume that are not directly adjacent to the dry ice may be warmer than the normal sublimation temperature. As the quantity of dry ice continues to decrease within the dry ice shipper due to sublimation, the average distance of separation of an interior location from the closest dry ice increases, thereby leading to an increased temperature at that location. Due to such phenomena, the internal volume of dry ice shippers typically exhibit temperature non-uniformity as dry ice continues to sublimate. A failure to maintain perishable items, including, but not limited to, biological materials, at the correct frozen temperature range for the required time-frame during transport can damage said materials.

Still further, dry ice or the liquid carbon dioxide precursor for dry ice is not always available in adequate supply in certain geographies. Hence, the inventors recognized a need for a solution that minimizes the amount of dry ice that is required by creating specially designed dry ice shippers that can produce the longer refrigeration times in a safe and controlled manner for a given volume of perishable items.

These aforementioned deficiencies were directly observed by the inventors with current, commercially available dry ice shippers upon having performed extensive test and screening of such dry ice shippers (as will be discussed below with regards to the Comparative Examples 1-24). Accordingly, the present invention has emerged that is directed to an improved dry ice shipper with unique structural features designed to deliver optimized performance in comparison to conventional shippers.

Figure 2:
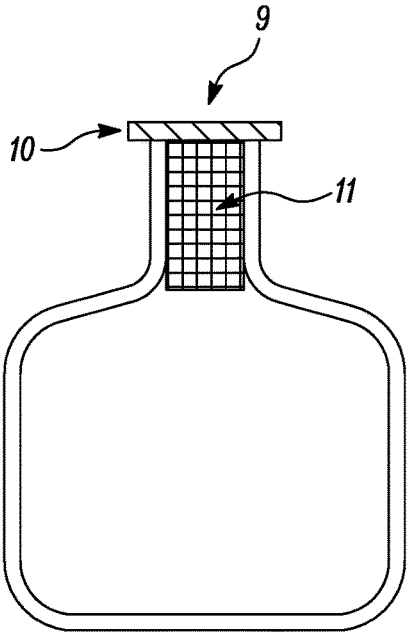
FIG. 2 illustrates a representative schematic of a dry ice shipper having an insulated cap that extends into a primary opening of the dry shipper, in accordance with the principles of the present invention and in which the contents region volume of the dry ice shipper is not occupied with dry ice and perishable items.

FIGS. 1 and 2 are representative schematics for describing certain aspects of the present invention. FIGS. 1 and 2 show a dry ice shipper 1. The dry ice shipper 1 has a contents region volume 8, illustrated by the bracketed region. The contents region volume 8 has a volume that is designed to accommodate one or more perishable items 21 in combination with a predetermined amount of dry ice 22. The portion of the contents region volume 8 allocated for the one or more perishable items 21 is referred to herein as $V_1$. The remaining portion of the contents region volume 8 (i.e., the portion not allocated for the one or more perishable items 21) is allocated for dry ice 22 and referred to herein as $V_D$. The precise amounts of perishable items 21 and the predetermined quantity of dry ice 22 within a dry ice shipper 1 allows for the requisite frozen temperature of the items 21 to be maintained for the entire duration of transport.

The contents region volume 8 is shown as a single and continuous space in which the one or more perishable items 21 and the dry ice 22 can intermix or be situated adjacent to each other. However, the exact spatial relationship of dry ice 22 in a first portion of the contents region volume 8 and one or more perishable items 21 in a second portion of the contents region volume 8 is not limited to that shown in FIG. 1. The arrangement shown in FIG. 1 is merely one example. The present invention contemplates any spatial relationship of dry ice 22 and the one or more perishable items 21 without departing from spirit of the present invention. For example, the contents region volume 8 can have one or more compartments or other suitable partition or barrier-like structures to segregate at least a portion of the one or more perishable items 21 that are situated therein from dry ice 22. Alternatively, the perishable items 21 may be stored in individual compartments within the contents region volume 8. Still further, the dry ice 22 may be stored within a dedicated dry ice region, such as an annular ring-like region that extends around the perishable items 21.

Referring to FIG. 1, the contents region volume 8 is substantially encapsulated by multiple walls. While not shown in FIG. 1, the multiple walls can be composed of one or more exterior walls 4 and one or more interior walls 3. The interior walls 3 are preferably in direct communication with the contents region volume 8 of the dry ice shipper 1, and the exterior walls 4 are preferably in direct communication with the surrounding environment 23. Discrete low pressure (i.e., vacuum) zones are created and maintained in between the one or more exterior walls 4 and the one or more interior walls 3. The joining of multiple interior walls 3 and exterior walls 4 create multiple discrete low pressure insulation zones that are separated from each other (not shown in FIG. 1). The one or more discrete low pressure insulation zones can achieve and maintain a high degree of insulative performance as quantified by certain design parameters, including, an overall heat transfer coefficient (U) and a loading ratio overall heat transfer coefficient ($U_R$), both of which will be explained in greater detail below. The one or more discrete low pressure insulation zones insulate the contents region volume 8 from unacceptable amounts of heat entering from the surrounding environment 23 of the shipper 1 through said multiple walls (3 and 4) (i.e., so-called "heat ingress").

It should be understood that the one or more discrete low pressure insulation zones are one type of insulation. Other types of insulation beside discrete low pressure insulation zones that are configured to surround the contents region volume 8 are contemplated by the present invention. Generally speaking, suitable discrete insulative elements can be utilized to sufficiently insulate the contents region volume 8 from unacceptable amounts of heat ingress.

The inventors have recognized that the degree of heat ingress for dry ice shippers is strongly correlated to "heat channel seams" of the dry ice shippers 1, and that a reduction, minimization or elimination of such heat channel seams can enhance performance of the dry ice shippers 1. "Heat channel seams" as used herein and throughout refer to a gap, joint or void that exists where multiple discrete low pressure insulation zones or other types of multiple discrete insulative elements of the dry ice shipper 1 are placed next to each other or joined together. Heat more easily leaks into the dry ice shipper 1 through such heat channel seams, and the inventors have observed that a large length of heat channel seams can substantially degrade performance of the dry ice shipper.

A heat channel seam is referred to as an "insulation heat channel seam" when it occurs between two discrete low pressure insulation zones or other types of discrete insulative elements not associated with the one or more openings into the shipper. The length of an insulation heat channel seam is the longest dimension of the seam that is oriented most orthogonal to the direction of heat flow passing through the seam and having the shortest path from the surrounding environment 23 into the contents region volume 8 of the dry ice shipper 1. The sum of all of the individual insulation heat channel seam lengths of the dry ice shipper 1 can be expressed as the total insulation heat channel seam length, designated as $L_{ins}$, and expressed in typical units of meters.

In a preferred embodiment, there is no discontinuity in the insulating interior 3 and exterior walls 4 as represented by FIG. 1. Consequently, the dry ice shipper 1 possesses a single continuous interior wall 3 surrounded by a single continuous exterior wall 4 with a single low pressure insulation zone maintained between the interior wall 3 and exterior wall 4. As a result, the total insulation heat channel seam length ($L_{ins}$) is equal to zero, meaning that insulation heat channel seam lengths along the sides and bottom of the dry ice shipper 1 have been eliminated. In other words, no insulation heat channel seams are available to facilitate heat ingress into the contents volume region 8. There is an absence of the multiple discrete insulative wall elements commonly used by conventional dry ice shippers.

In addition to the need to reduce, minimize or eliminate the total insulation heat channel seam length ($L_{ins}$), the inventors have also recognized that the one or more openings 5 of the dry ice shipper 1 of FIGS. 1 and 2, can represent significant sources of heat ingress from the surrounding environment 23 to the contents region volume 8 of dry ice shipper 1. Referring to FIG. 2, the dry ice shipper 1 includes an insulated cap 9 that isolates the opening 5 from the surrounding environment 23 to create confinement of the contents (i.e., dry ice 22 and one or more perishable items 21) during storage, preservation and/or transport. As shown in FIG. 2, the cap 9 is preferably comprised of a cover 10 that spans the full opening and a plug 11 of adequate insulating material that fits into the full cross-sectional area of the neck region 6 (described in more detail below and shown as the bracketed region in FIG. 1 between the opening 5 and the contents region volume 8). The plug 11 has a depth that preferably fits substantially the full length of the neck region 6. The cap 9 is maintained on the dry ice shipper 1 when its contents (i.e., dry ice 22 and one or more perishable items 21) are not being loaded into or removed from opening 5 of the shipper 1. This so-called "closure" created by insulated cap 9 does not completely seal the opening 5, thereby allowing carbon dioxide that is generated inside the shipper 1 as a result of sublimation of dry ice 22 to freely escape from the contents region volume 8 and emerge into the surrounding environment 23. Such closure prevents the possibility of pressure build-up within the shipper 1.

The size of the passageway created by the insulated cap 9 through opening 5 is preferably optimized so as to minimize heat ingress into dry ice shipper 1 from the surrounding environment 23 while allowing carbon dioxide off-gas venting to minimize pressure build-up in the internal volume of contents region 8.

Alternatively, when more than one opening 5 is employed by the dry ice shipper 1, it should be understood that the shipper 1 is considered "closed" or considered to be in a "closed state" when each of the one or more openings 5 is fitted with a corresponding insulative cap 9 in the manner described hereinabove.

Although insulated cap 9 with plug 11 is illustrated, other designs are contemplated to create a channel or passageway through which the carbon dioxide off-gas can escape from the contents region volume 8, thereby substantially reducing or eliminating pressure build-up of carbon dioxide gas that is formed during storage, preservation and/or transport of items in the shipper 1. Any suitable insulated cap which can vent excess carbon dioxide pressure while minimizing heat gain is contemplated.

When the dry ice shipper 1 is in a closed state, a heat channel seam extends along each opening 5. Such heat channel seam is referred to as an "opening heat channel seam." A total opening heat channel seam length designated as $L_{open}$ is expressed in typical units of meters and calculated as the sum of all of the individual opening heat channel seam lengths that the shipper 1 contains. By way of example, such opening heat channel seam length can be a circumference for openings 5 of circular shape and a perimeter for openings 5 of rectangular shape. The total opening heat channel seam length $L_{open}$ for the present invention is designed to be smaller in circumference (for small circular-shaped dry ice shippers) and perimeter (for rectangular-shaped dry ice shippers) than conventional shippers with similar intended payload volumes. The inventors have observed that each opening potentially compromises the insulative performance of the exterior 4 and interior walls 3. While multiple openings 5 may be advantageous for accessibility into various sections of the contents region volume 8, because each opening 5 serves as an access point into the dry ice shipper 1, it will require a corresponding removable section of one or more of the multiple discrete low pressure insulation zones or one or more of the multiple discrete insulative elements. Removal of a portion of such zones can degrade the overall performance by allowing the dry ice shipper to be more susceptible to heat ingress. Consequently, in accordance with the principles of the present invention, the number of access openings along the dry ice shipper 1 is minimized to reduce possible heat conductive pathways which have the potential of increasing heat ingress into the dry ice shipper 1. In the preferred embodiment of the present invention, as shown in FIGS. 1 and 2, a dry ice shipper 1 is optimally designed to have a single opening. The single opening 5 is sized to only be as large as needed to enable loading of dry ice 22 and the one or more perishable items 21. In this manner, an excessively sized opening is eliminated to minimize heat ingress from the surrounding environment 23. The dry ice shipper 1 in FIGS. 1 and 2 show an opening 5, which serves as the primary and sole opening 5 that is restrictively sized to allow a user to load one or more perishable items 21 and dry ice 22 into the contents region volume 8 as well as remove therefrom. "Restrictively sized" is intended to exclude overly or excessively sized openings that represent large opening heat channel seam lengths which cause significant heat ingress therethrough.

Alternatively, it should be understood that the present invention can have more than one opening that extends into the insulative exterior walls 4 and internal walls 3, whereby each of such openings 5 is restrictively sized to enable the loading of dry ice 22 and perishables items 21, but not be overly or excessively sized so as to represent a substantial opening heat channel seam length that causes significant heat ingress therethrough. While such a design may be prone to more heat ingress as a result of a total opening heat channel seam length ($L_{open}$) that is higher than that of FIG. 1, a dry ice shipper with multiple openings may be acceptable for certain applications, such as, for example, where less cooling duration is sufficient as a result of shorter transport times and/or where the need for ease of handling via the dry ice shipper having multiple access points outweighs the benefits of minimized heat ingress, without departing from the spirit and scope of the present invention.

Having designed an improved dry ice shipper with structural features in which the total insulation heat channel seam length ($L_{ins}$) and the total opening heat channel seam length ($L_{open}$) represent paths with significantly lower heat transfer resistance through which heat ingress occurs from the surrounding environment 23 into the contents region volume 8, the dry shipper 1 can be characterized by a total heat channel seam length $L_T$ (typically expressed in units of meters) by $$L_T = L_{ins} + L_{open} \quad \text{(equation 1)}$$

The heat channel seam effects between dry ice shippers can be more meaningfully compared by normalizing the total heat channel seam length $L_T$ into a normalized total heat channel seam length, designated as $L_N$, as follows:

$$L_N = \frac{L_T}{L_S} \quad \text{(equation 2)}$$

where $L_s$ is the sum of the maximum lengths of the three external dimensions of the dry ice shipper 1 (e.g., the maximum length+maximum width+maximum height of a rectangular container or the maximum diameter+maximum diameter+maximum height of a cylindrical container). The normalized total heat channel seam length ($L_N$) is a dimensionless parameter that quantifies certain structural features of the dry ice shipper 1. Lower values of $L_N$ denote a relatively lower incidence of heat channel seams for a particular dry ice shipper 1 as a result of minimal openings 5 and/or smaller sized openings 5 in combination with a reduction in the number of panels and/or walls that are required to be joined so as to reduce the number of multiple discrete low pressure insulation zones of the dry ice shipper 1. In one embodiment, the dry ice shipper 1 is parameterized by a normalized heat channel seam length of 0.6 or less but greater than 0. In another embodiment, the dry ice shipper 1 is parameterized by a normalized heat channel seam length of 0.6 or less, but greater than about 0.2. On the contrary, conventional dry ice shippers are constructed to have significantly greater values for the normalized heat channel seam length, in the range of 0.8 to 3 or greater as shown for the example shippers in Table 1 below. The combination of a total insulation heat channel seam length ($L_{ins}$) that is equal to zero with a total opening heat channel seam length ($L_{open}$) that is defined by a single opening which is restrictively sized is one aspect of the present invention that produces substantially lower normalized total heat channel seam length ($L_N$) values as demonstrated in Examples 9-12 and shown in Table 2 in comparison to conventional dry ice shippers, as demonstrated in Comparative Examples 13-18 and shown in Table 1.

It is further preferred that each opening 5 be physically separated from the contents region volume 8 of the shipper 1. Referring to FIG. 1, the neck region 6 is defined as that portion of the internal volume of the shipper 1 positioned between the opening 5 and the contents region volume 8. Although FIG. 1 shows a shipper 1 with a single neck region 6, shippers 1 with more than one opening 5 where each opening 5 has its own associated neck region 6 as defined hereinabove, are contemplated by the present invention. The remainder of the internal volume of the dry ice shipper 1 that does not include the neck region(s) 6 is intended to represent the contents region volume 8 where dry ice 22 and/or perishable items 21 may be located. Dry ice 22 and perishable items 21 are not intended to be stored in the neck region 6. In preferred embodiments, as described hereinabove, the plug 11 of insulating material included with the cap 9 has a depth that preferably fits substantially the full length of the neck region 6 when the shipper 1 is closed, which substantially excludes or entirely eliminates the dry ice 22 or perishable items 21 from occupying a location within the neck region.

It is further contemplated that each opening 5 is thermally separated from the contents region volume 8. Such thermal separation can be achieved by constructing the interior wall of the neck 6 from a suitable commercially available material as known in the industry to exhibit relatively low thermal conductivity.

As heat enters the internal volume of the dry ice shipper 1 from the surrounding environment 23, the predetermined amount of dry ice 22 inside a first portion of the volume of the contents region 8 of the shipper 1 sublimates into carbon dioxide vapor (i.e., CO2 gas or CO2 off-gas). In particular, the rate of heat ingress Q in units of kiloJoules per hour (kJ/hr) can be calculated using the following relationship:

$$Q=U*A*(T_{ext}-T_{int}) \quad \text{(equation 3)}$$

where U is the overall heat transfer coefficient of the shipper 1 in units of kiloJoules per hour per square meter per degree Celsius (kJ/hr/m$^2$/° C.), A is the internal surface area of the shipper 1 in units of square meters (m$^2$), $T_{ext}$ is the temperature of the external surroundings 23 in units of degrees Celsius (° C.), and $T_{int}$ is the temperature of the contents region volume 8 in units of degrees Celsius (° C.). The present invention exhibits a lower overall heat transfer coefficient (U) relative to conventional shippers. The lower overall heat transfer coefficient (U) is indicative of increased resistance to heat ingress into the contents region volume 8. In preferred embodiments, the shipper 1 has an overall heat transfer coefficient (U) less than 0.5 kJ/hr/m$^2$/° C. but greater than 0, when each of the one or more openings 5 are closed, as shown in Examples 1-4 and 17 below. In another embodiment, the shipper 1 has an overall heat transfer coefficient that is 0.5 kJ/hr/m$^2$/° C. or less, but greater than about 0.1 kJ/hr/m$^2$/° C., with all of the openings 5 closed. Still further, in another embodiment, the shipper 1 has an overall heat transfer coefficient between about 0.15 and 0.5 kJ/hr/m$^2$/° C. with all of the openings 5 closed. Table 2 lists the U values when example inventive shippers W, X, Y and Z are in the closed state, and Example 17 provides the U value for example inventive shipper V. In comparison, conventional dry ice shippers typically have significantly higher overall heat transfer coefficient values ranging between 0.9 kJ/hr/m$^2$/° C. and 2 kJ/hr/m$^2$/° C. or greater as shown in Comparative Examples 1-6 below and tabulated in Table 1.

The dry ice shipper 1 of the present invention also provides much better resistance to heat ingress in the open state (i.e., when the opening 5 of shipper 1 is open to the surrounding environment 23 by removal of the insulated cap 9) compared to conventional shippers. Open state resistance to heat ingress is important because shippers can spend a significant time in the open state if their contents are accessed frequently by users or if the cap is accidentally removed. In preferred embodiments, the shipper 1 has an overall heat transfer coefficient (U) less than 1.0 kJ/hr/m$^2$/° C. but greater than 0, when each of the one or more openings 5 are open. In another embodiment, the shipper 1 has an overall heat transfer coefficient that is 1.0 kJ/hr/m$^2$/° C. or less, but greater than about 0.2 kJ/hr/m$^2$/° C., with all of the openings 5 open. The overall heat transfer coefficient (U) for the example inventive shippers W-Z and V of the present invention ranged from 0.31 to 0.93 kJ/hr/m$^2$/° C. as described in Examples 5-8 and 17 and listed in Table 2. Surprisingly, the overall heat transfer coefficient (U) for the example inventive shippers increased to a value less than expected when the opening 5 of each of the shippers 1 was not fitted with insulated cap 9 and therefore in contact with the surrounding environment 23. In comparison, conventional dry ice shippers typically have significantly higher overall heat transfer coefficient values ranging between 3 kJ/hr/m$^2$/° C. and 5 kJ/hr/m$^2$/° C. or greater, when in an open state as shown in Comparative Examples 7-12 below and listed in Table 1. These substantially higher values for U in the open and closed state for shippers A-F are believed to be representative of the inferior performance of conventional shippers.

In addition to an improved U, the shipper 1 of the present invention has been further designed to be capable of allocating less volume for dry ice 22 and more volume for perishable items 21 relative to conventional shippers. In this regard, the present invention introduces a new parameter called a loading ratio, designated as R, which is defined as the ratio of the first portion of the contents region volume 8 for holding dry ice 22 having a value of $V_D$ to the second portion of the contents region volume 8 for holding one or more perishable items 21 having a value of $V_1$.

$$R=\frac{V_D}{V_I} \quad \text{(equation 4)}$$

The loading ratio (R) represents the amount of refrigeration utilized per unit volume of perishable item. Referring to FIG. 1, the contents region volume 8 is apportioned between the volume for holding the one or more perishable items $V_1$ (in units of m$^3$) and the volume for holding the dry ice $V_D$ (in units of m$^3$). Generally speaking, an increase in the volume for holding the dry ice 22 increases the loading ratio (R) and the potential refrigeration capacity of the dry ice shipper 1 for maintaining the one or more perishable items 21 in a frozen state, but also decreases the available space to hold the one or more perishable items 21. Conversely, a decrease in the volume for holding the dry ice 22 decreases the loading ratio (R) and the potential refrigeration capacity of the dry ice shipper 1 for maintaining the one or more perishable items 21 in a frozen state, but increases the available space to hold the one or more perishable items 21 therein. The present invention can create and maintain sufficient refrigeration capacity without unnecessarily decreasing the volume that is apportioned for holding the one or more perishable items 21.

In one embodiment, the shipper of the present invention has a loading ratio parameter (R) that can take on any value of 4 or less, but greater than 0, which is smaller than conventional shippers which require a loading ratio ranging from 6 to 13 as shown for the example shippers in Table 1. In another embodiment, the loading ratio parameter (R) of the present invention is 4 or less, but greater than 0.5. Table 2 lists the R values for example inventive shippers W, X, Y and Z. The lower loading ratio parameter (R) of the present invention can surprisingly produce sufficient refrigeration capacity with relatively smaller quantities of dry ice 22 in the internal volume in comparison to conventional shippers, while creating more internal volume that is available for perishable items 21.

Having minimized the overall heat transfer coefficient (U) and loading ratio (R), the present invention can be further parameterized. The overall heat transfer coefficient (U) of the dry ice shipper 1 is normalized into a loading ratio overall heat transfer coefficient ($U_R$) that is calculated as the multiplicative product of U and R.

$$U_R=U*R \quad \text{(equation 5)}$$

The loading ratio overall heat transfer coefficient ($U_R$) is a meaningful indicator of the performance of the inventive shippers that serves as a normalized value for the overall heat transfer coefficient (U), which enables the performance of dry ice shippers 1 of the present invention to be assessed against conventional shippers. The loading ratio overall heat transfer coefficient ($U_R$) represents a key design criterion for the present invention, as the parameter takes into design consideration the relatively lower amount of dry ice 22 in the shipper 1 within the first portion of the contents region volume 8 ($V_D$) that is configured to provide effective refrigeration for a relatively larger amount of perishable items that is held in the second portion of the contents region volume 8 ($V_1$). In one embodiment, the loading ratio overall heat transfer coefficient ($U_R$) of dry ice shipper 1 is less than 2 kJ/hr/m$^2$/° C., but greater than 0, when each of the one or more openings 5 is closed; and in another embodiment, 1.85 kJ/hr/m$^2$/° C. or less, but greater than 0, when each of the one or more openings 5 is closed. In another embodiment, the loading ratio overall heat transfer coefficient ($U_R$) is less than 4 kJ/hr/m$^2$/° C., but greater than 0, when each of the one or more openings 5 is open; and in another embodiment, 3.5 kJ/hr/m$^2$/° C. or less, but greater than 0.5 kJ/hr/m$^2$/° C., when each of the one or more openings 5 is open. Table 2 lists the $U_R$ values for example inventive shippers W, X, Y and Z in the closed state and in the open state, and Example 17 provides the $U_R$ values for example inventive shipper V. $U_R$ in the closed state is determined by multiplying the R value for each shipper by the corresponding U value determined in the closed state. $U_R$ in the open state is determined by multiplying the R value for each shipper by the corresponding U value determined in the open state. The R value for each shipper remains the same in the closed state and the open state. By comparison, the inventors have determined that conventional dry ice shippers have notably higher loading ratio overall heat transfer coefficients ($U_R$) when the openings of the shippers are closed (Table 1), which can be attributed to inferior cooling as a result of subpar insulative performance in combination with an interior volume that requires relatively more dry ice per unit volume of perishable item than required by the present invention. Furthermore, the $U_R$ performance of the conventional shippers is exacerbated when the shippers have their respective caps removed from the openings and are exposed to the surrounding environment; Table 1 shows the $U_R$ values are significantly higher when the shippers are open to the surrounding environment. The relatively lower loading ratio overall heat transfer coefficient ($U_R$) of the present invention is indicative of the superior overall performance in comparison to conventional shippers, while maintaining the ability to provide a generally compact shipper that can be transported and ergonomically handled.

The present invention further parameterizes the structural features of the dry ice shippers 1 with a normalized loading ratio heat channel factor designated as F, which is defined as the multiplicative product of the normalized heat channel seam length (Liv) and loading ratio (R)

$$F=L_N*R \quad \text{(equation 6)}$$

whereby $L_N$ and R are as defined and described hereinabove. The normalized loading ratio heat channel factor (F) is a dimensionless parameter that provides a meaningful basis for performance comparison of shippers. A lower value of F is desirable as it is indicative of a dry ice shipper that more efficiently uses its payload space for conveyance of frozen items. In preferred embodiments, the inventive dry ice shipper has a normalized loading ratio heat channel factor (F) that is 1.5 or less but greater than 0. The normalized loading ratio heat channel factor (F) for the example inventive shippers W-Z of the present invention ranged from 0.50 to 1.06 as described in Examples 9-12 and listed in Table 2. In comparison, and as will be explained below, the value of the normalized loading ratio heat channel factor (F) for conventional dry ice shippers, as demonstrated by tests of shippers A-F in Comparative Examples 13-18 and listed in Table 1, ranged from about 6 to 34.

The dry ice shipper 1 of the present invention is designed in an optimized manner so as to exhibit favorable temperature behavior and trends. In preferred embodiments, the dry ice shipper 1 of the present invention has the ability to maintain all locations within the contents region volume 8 at or below −70° C. when at least 10 vol % of the contents region volume 8 is occupied with dry ice 22 with each of the one or more openings 5 of the dry ice shipper 1 in a closed state. In another embodiment, when at least 2 vol % of the contents region volume 8 is occupied with dry ice 22, the dry ice shipper 1 of the present invention is structurally configured to maintain all locations within the contents region volume 8 at or below −60° C. The performance data for example inventive dry ice shippers W-Z is graphically shown in FIGS. 4, 6, 9 and 10 with the corresponding tests described at Examples 13-16. In comparison, many of the conventional shippers, as represented by Shippers A-F in Comparative Examples 19-24 and shown in FIGS. 3 and 5 cannot maintain all locations within the contents region volume below −70° C. when as much as 70-80 vol % of the contents region volume is occupied with dry ice and each of the one or more openings of the dry ice shipper are closed. Furthermore, the temperature capabilities of such conventional shippers become significantly worse in a substantially linear-like fashion as less dry ice is occupying the contents region volume as demonstrated in FIGS. 3 and 5. In this regard, FIG. 3 shows a rapid increase in the warmest temperature measured in the contents region volume as dry ice reduces from about 80 vol % to 10 vol %.

The dry ice shippers of the present invention are configured to provide a surprisingly high resistance to internal temperature change as their dry ice contents sublimate away compared to the behavior exhibited by conventional shippers. This resistance can be characterized by determining the average rate of change for the warmest temperature measured in the contents region volume 8 for a specific value of the percentage of the contents region volume 8 containing dry ice 22 that is remaining after a portion thereof has sublimated (henceforth, referred to by abbreviation, as the "average rate of change of the warmest temperature"), which is defined by the following sequence of calculations. First, the temperature difference of (a) minus (b) is determined, where (a) is the warmest temperature measured in the contents region volume 8 when the portion of the contents region volume 8 for holding dry ice 22 is maximally loaded with dry ice 22 (with the remainder of the contents region volume 8 holding the perishable items 21); and (b) is the warmest temperature measured in the contents region volume 8 as dry ice 22 sublimates and is reduced from the maximally loaded amount to a specific value of the percentage of the contents region volume 8 containing dry ice 22. Second, the temperature difference of (a) minus (b) is divided by the difference in values of the percentage of the contents region volume 8 containing dry ice 22 of (x) minus (y), where (x) corresponds to the percentage of the contents region volume 8 containing the maximal amount of dry ice at (a); and (y) corresponds to the percentage of the contents region volume 8 containing dry ice after sublimation to produce (b). In one embodiment of the present invention, when dry ice 22 sublimates and is reduced in the contents region volume 8 of the dry ice shipper 1 from an initial amount occupying up to about 80 vol % to a final amount occupying a percentage of the contents region volume 8 less than the initial amount and no less than about 10 vol % of the contents region volume 8, the average rate of change of the warmest temperature between the initial amount and the final amount is between 0 and 0.05 degrees Celsius per incremental 1 vol % decrease in the percentage of the contents region volume 8 containing dry ice 22 that is remaining (this meaning for the units for average rate of change henceforth abbreviated herein and in FIGS. 5, 6 and 10 as "° C./%"). In another embodiment, the average rate of change of the warmest temperature between the initial amount and the final amount is between 0 and 0.03° C./%. By contrast the average rate of change of the warmest temperature for conventional shippers generally ranges between 0.2 and 2.0° C./%, with even higher values possible.

Figure 3:
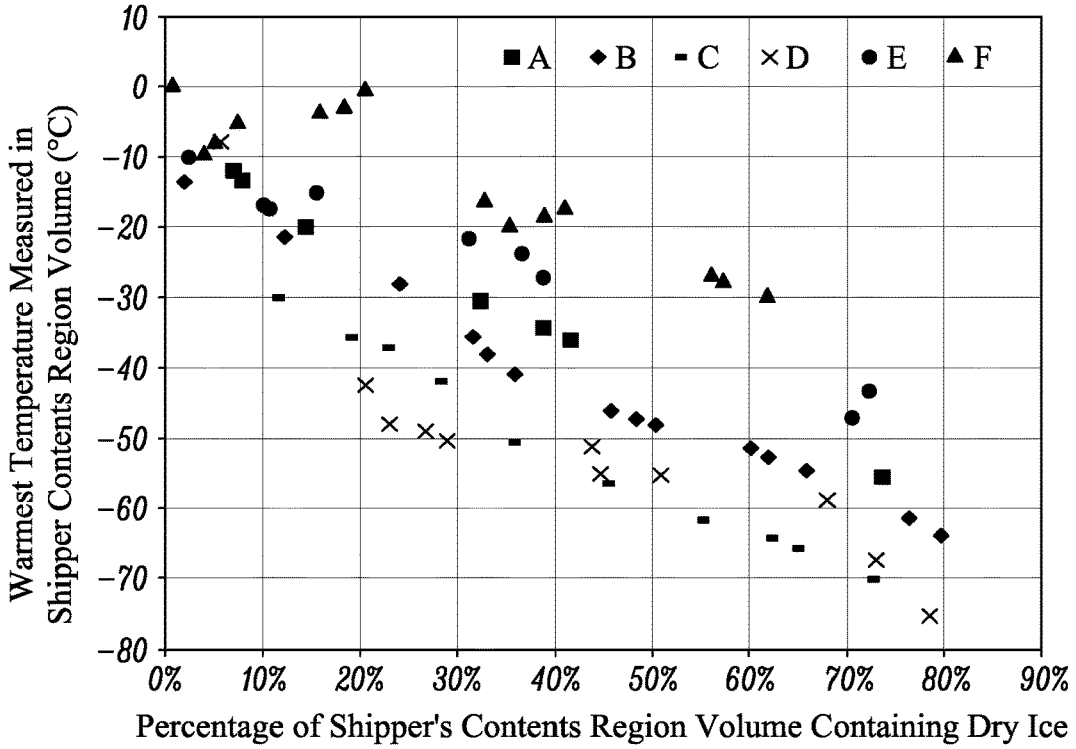
FIG. 3 illustrates a graphical display of the warmest temperature measured inside a conventional dry ice shipper as a function of the percentage of the contents region volume containing dry ice.
Figure 4:
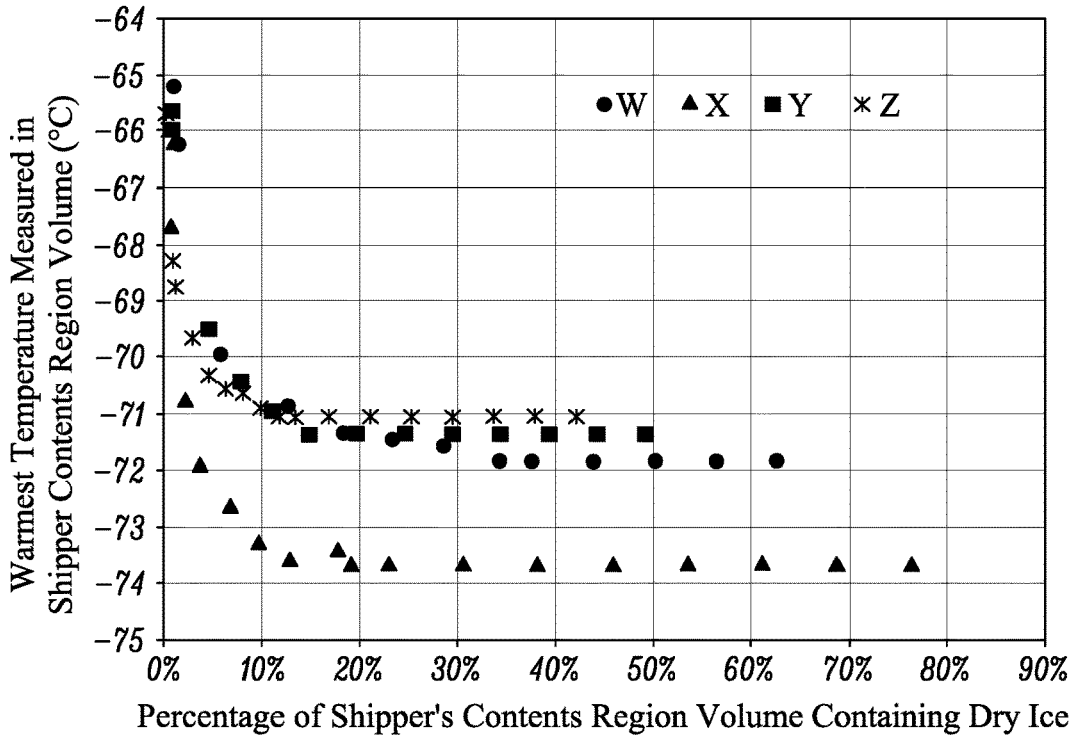
FIG. 4 illustrates a graphical display of the warmest temperature measured inside a dry ice shipper of the present invention as a function of the percentage of the contents region volume containing dry ice.
Figure 5:
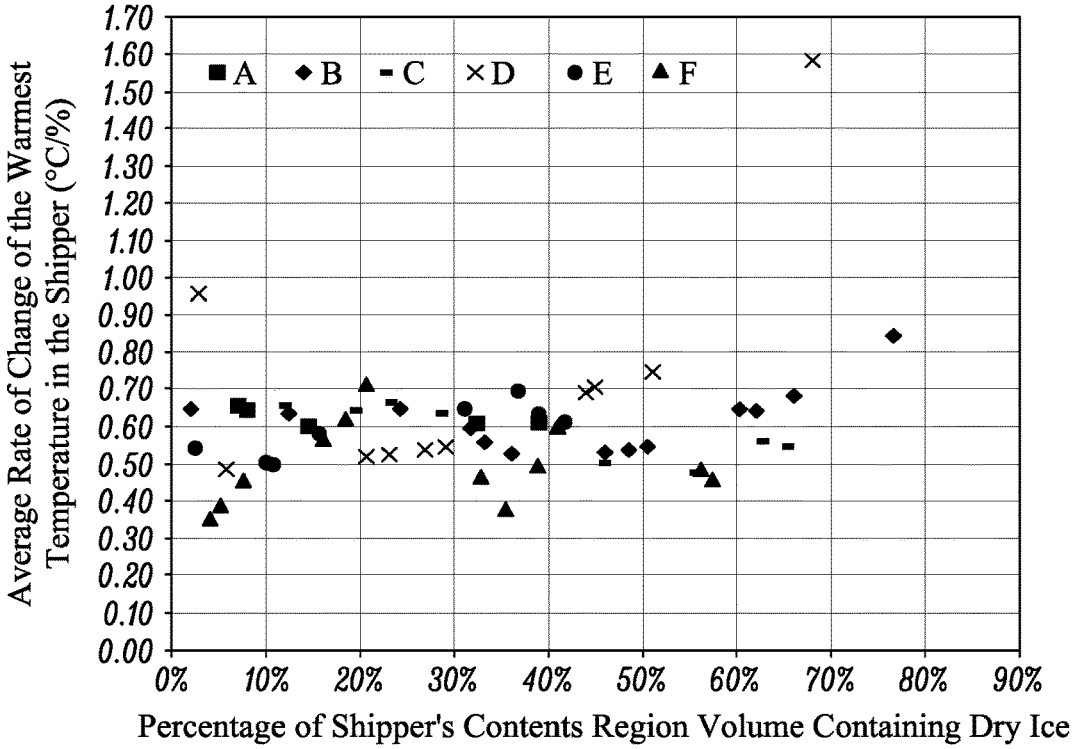
FIG. 5 illustrates a graphical display of the average rate of change of the warmest temperature measured inside a conventional dry ice shipper as a function of the percentage of the contents region volume containing dry ice.
Figure 6:
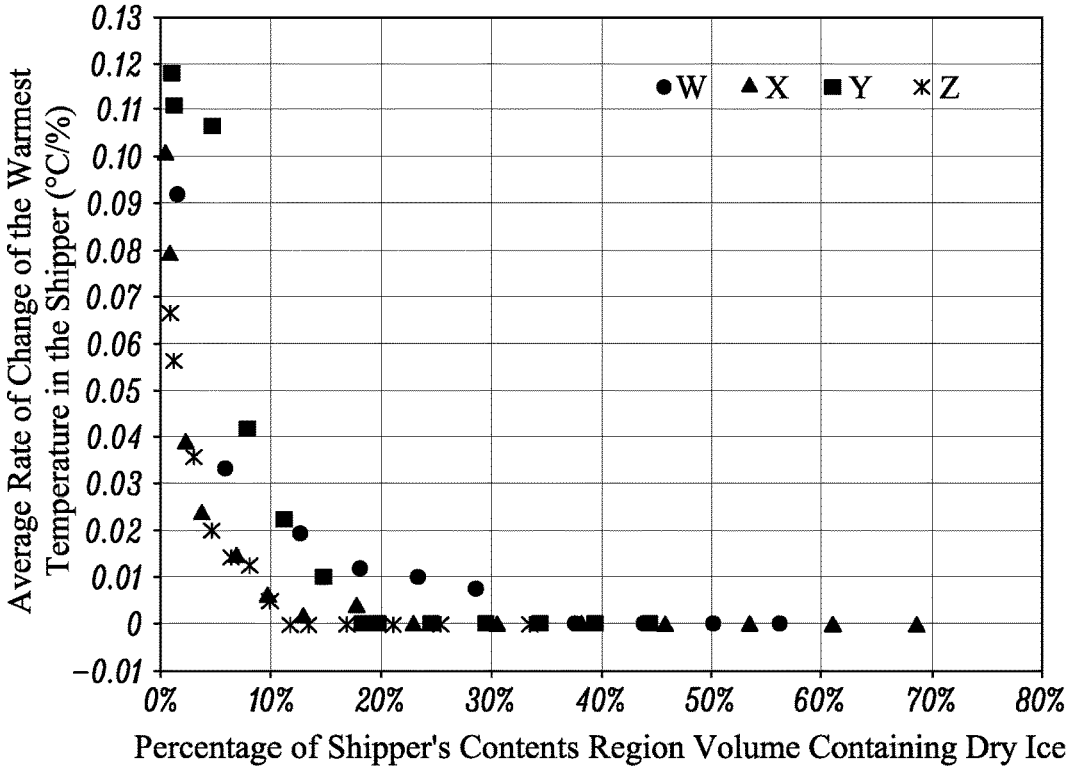
FIG. 6 illustrates a graphical display of the average rate of change of the warmest temperature measured inside a dry ice shipper of the present invention as a function of the percentage of the contents region volume containing dry ice.

Based on the data shown in FIGS. 3 and 4, the results for the average rate of change of the warmest temperature for conventional shippers A-F and inventive shippers W-Z are shown in FIG. 5 and FIG. 6, respectively. As exemplified in FIG. 5, this average rate of change of the warmest temperature for conventional shippers A-F generally ranges between about 0.3 to 0.8° C./%. Moreover, the conventional shippers A-F also exhibit values of the average rate of change of the warmest temperature significantly greater than 0.8° C./%, which indicates that conventional shippers are prone to even a greater amount of internal warming as dry ice sublimates over time. On the contrary, the present invention exhibits resistance to changes in the warmest temperature of the shipper contents region volume 8 as dry ice 22 sublimates and is reduced in amount within the contents region volume 8. In fact, as shown in FIG. 6 and described in Examples 13-16, when dry ice 22 sublimates and is reduced in the contents region volume 8 of the dry ice shipper 1 from initially occupying about 80 vol % to occupying about 10 vol % of the contents region volume 8, the average rate of change of the warmest temperature of the inventive shippers W-Z remains relatively constant, only exhibiting an average rate of change of the warmest temperature between 0 and 0.03° C./%.

Figure 10:
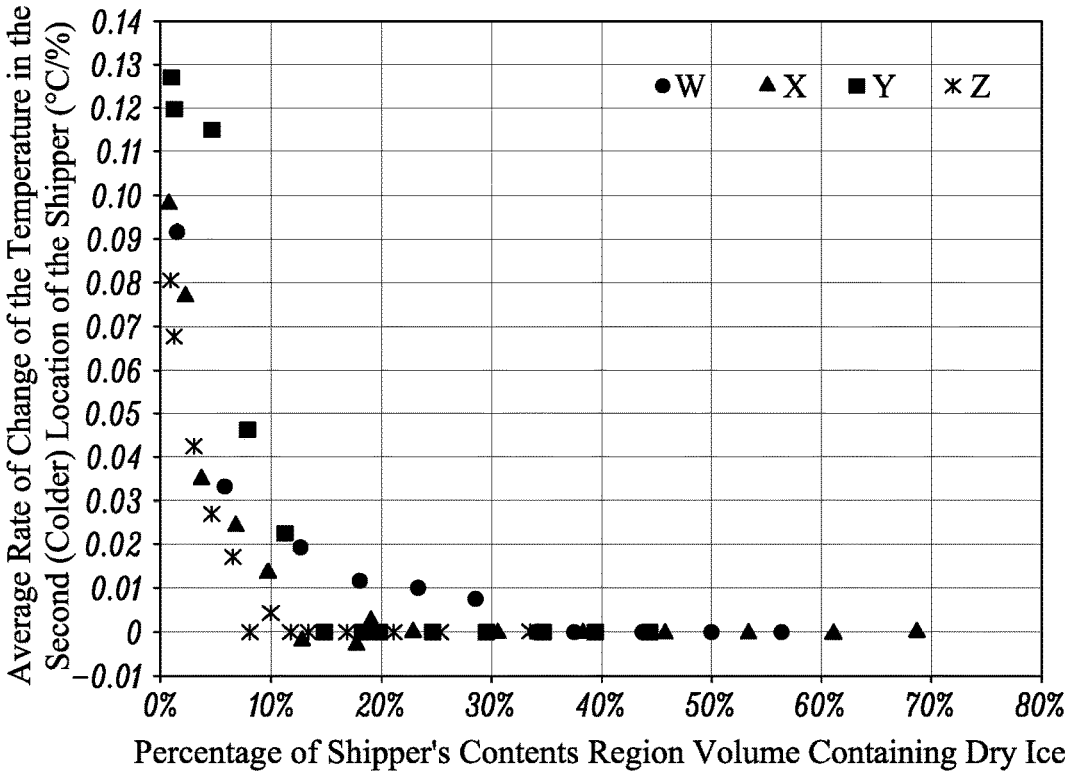
FIG. 10 illustrates a graphical display of the average rate of change of the temperature of the second (colder) location measured in FIG. 9 inside a dry ice shipper of the present invention as a function of the percentage of the contents region volume containing dry ice.

It is further noted that the average rate of change in the measured temperature of any location within the contents region volume 8 of dry ice shipper 1 as dry ice 22 sublimates will be similar to the average rate of change in the measured temperature of the warmest location (see example FIG. 10). In one embodiment of the present invention, the average rate of change of the temperature of any location within the dry ice shipper 1 is between 0 and 0.05° C./% when dry ice 22 sublimates and is reduced in the contents region volume 8 of the dry ice shipper 1 from an initial amount occupying up to about 80 vol % to a final amount occupying a percentage of the contents region volume 8 less than the initial amount and no less than about 10 vol % of the contents region volume 8, and, in another embodiment, the average rate of change of the temperature of any location is between 0 and 0.03° C./%.

Figure 7:
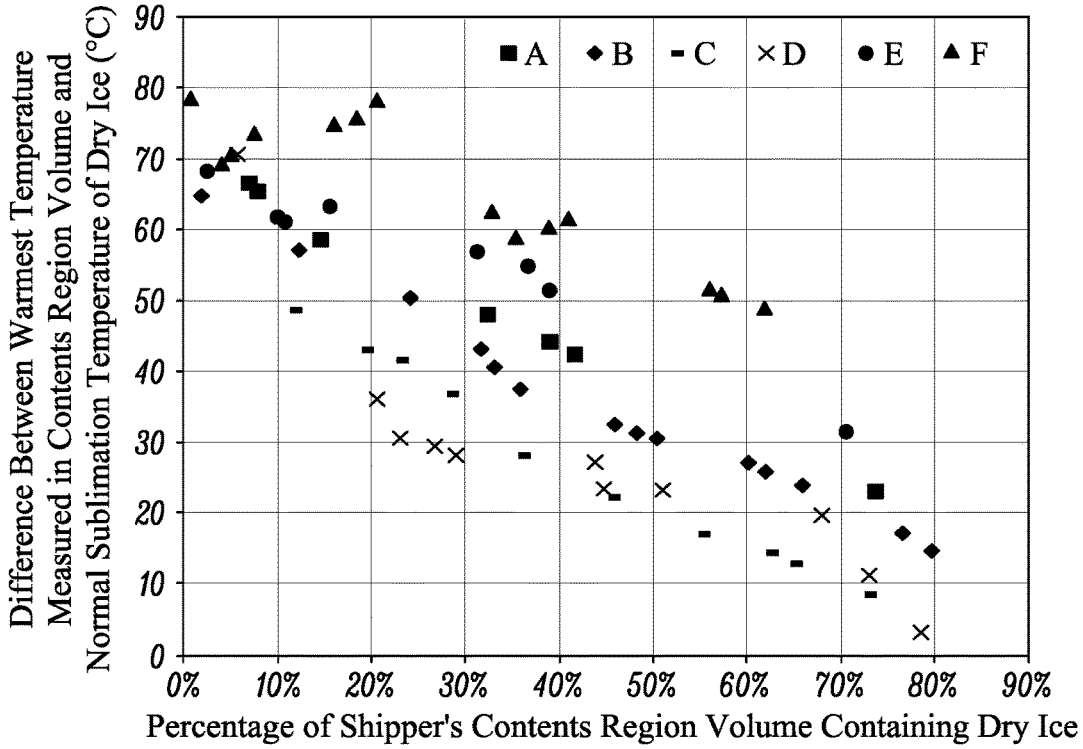
FIG. 7 illustrates a graphical display of temperature uniformity inside a conventional dry ice shipper as a function of the percentage of the contents region volume containing dry ice.
Figure 8:
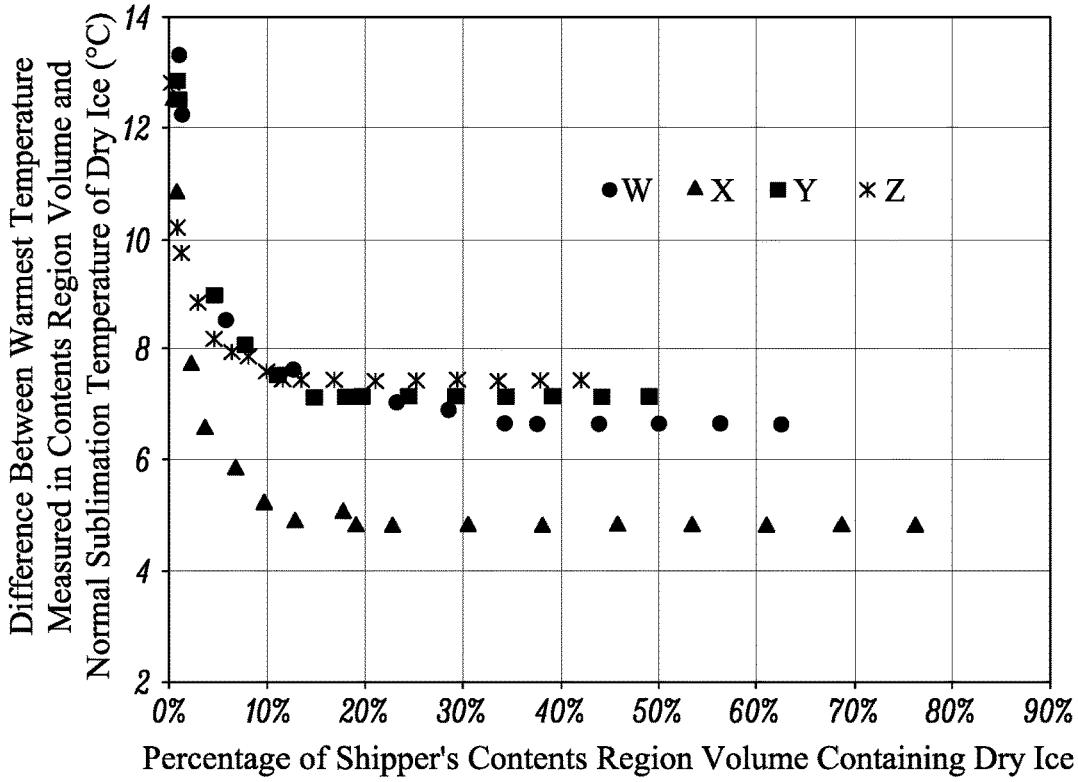
FIG. 8 illustrates a graphical display of temperature uniformity inside a dry ice shipper of the present invention as a function of the percentage of the contents region volume containing dry ice.

The dry ice shipper 1 of the present invention also exhibits improved temperature uniformity as demonstrated by the test results shown in FIGS. 7 and 8. With regards to the present invention, the temperature uniformity is characterized by the "largest temperature difference," defined as the difference between the warmest temperature measured in the contents region volume 8 of the dry ice shipper 1 and the normal sublimation temperature of dry ice 22 for a particular percentage of a shipper's contents region volume 8 containing dry ice. It should be understood that subcooling effects of dry ice do not need to be taken into consideration to obtain a reasonable estimation of the maximum temperature difference inside the shipper for purposes of comparison with other shippers. In the present invention, the largest temperature difference is less than 10 degrees Celsius when only about 5 vol % of the contents region volume 8 contains dry ice 22 (see FIG. 8 and Examples 13-16) with each of the one or more openings 5 in a closed state, and in another embodiment, the largest temperature difference is less than 8 degrees Celsius when only about 10 vol % of the contents region volume 8 contains dry ice 22 (see FIG. 8 and Examples 13-16). On the contrary, when about 5 vol % of the contents region volume of conventional shippers in the closed state contains dry ice, the results are significantly worse; Comparative Examples 19-24 with resultant data shown in FIG. 7 exhibit a largest temperature difference that is 65-80 degrees Celsius, which represents a factor of 8-10 times greater non-uniformity than that of the present invention. Furthermore, the largest temperature difference within the conventional shippers worsens in a substantially linear-like fashion as less dry ice 22 is occupying the contents region volume 8 as demonstrated in FIG. 7. In this regard, FIG. 7 shows a rapid increase in the largest temperature difference within the contents region volume 8 as dry ice 22 reduces from up to about 80 vol % to 10 vol %. On the contrary, the present invention exhibits resistance to changes in its largest temperature difference as dry ice 22 sublimates and is reduced in amount within the contents region volume 8. In fact, as shown in FIG. 8 and described in Examples 13-16, as dry ice 22 sublimates and is reduced in the contents region volume 8 of the dry ice shipper 1 from occupying about 80 vol % to occupying about 10 vol % of the contents region volume 8, the largest temperature difference within the inventive shippers W-Z remains relatively constant.

Based on the data shown in FIGS. 7 and 8, the average rate of change of the largest temperature difference within the contents region volume 8 at a specific value of the percentage of the contents region volume 8 containing dry ice (henceforth, referred to by abbreviation as the "average rate of change of the largest temperature difference") is calculated for the conventional shippers A-F and inventive shippers W-Z, respectively. First, the temperature difference of (c) minus (d) is determined, where (c) is the largest temperature difference measured in the contents region volume 8 when the portion of the contents region volume 8 for holding dry ice 22 is maximally loaded with dry ice 22 (with the remainder of the contents region volume 8 holding the perishable items); and (d) is the largest temperature difference measured in the contents region volume 8 as dry ice 22 sublimates and is reduced from the maximally loaded amount to a specific value of the percentage of the contents region volume 8 containing dry ice 22. Second, the temperature difference of (c) minus (d) is divided by the difference in values of the percentage of the contents region volume 8 containing dry ice of (e) minus (f), where (e) is the percentage of the contents region volume 8 containing dry ice corresponding to (c); and (f) is the percentage of the contents region volume 8 containing dry ice corresponding to (d). Comparing the definitions of the warmest temperature and the largest temperature difference measured in the dry ice shipper 1 (and the plots of the exemplifying data in FIGS. 3, 4, 7, and 8), the average rate of change of the largest temperature difference is the same as the average rate of change of the warmest temperature for the same shipper under the same conditions. Hence, one embodiment of the present invention exhibits an average rate of change of the largest temperature difference within the dry ice shipper 1 between 0 and 0.05° C./% when dry ice 22 sublimates and is reduced in the contents region volume 8 of the dry ice shipper 1 from an initial amount occupying up to about 80 vol % to a final amount occupying a percentage of the contents region volume 8 less than the initial amount and no less than about 10 vol % of the contents region volume 8, and, in another embodiment, the average rate of change of the largest temperature difference is between 0 and 0.03° C./%. Meanwhile, conventional shippers exhibit much larger rates of change of the largest temperature difference generally between 0.3° C./% and 0.8° C./% and, notably, also includes larger average rates of change of the largest temperature difference.

It should be understood that the dry ice shippers of the present invention are applicable with inventors' pre-charging CO2 inventive techniques described in Serial application Ser. No. 16/223,233; the apparatuses described in application Ser. No. 15/645,152; the automated systems, including automated charging systems, as described in application Ser. No. 16/221,906; the transportable in-situ container and charger system of U.S. Pat. No. 10,712,072 and application Ser. No. 16/895,688, and the methods and systems for thermally filling thermally insulated containers with dry ice of U.S. Pat. No. 10,330,200 and application Ser. No. 16/510,027, each of which is incorporated by reference in their respective entireties for all purposes.

It should be understood that any combination of one or more of the embodiments described with regards to the present invention are within the scope of the disclosure. For example, in one aspect of the present invention, the dry ice shipper 1 can have a loading ratio overall heat transfer coefficient ($U_R$) of 0.5 kJ/hr/m$^2$/° C. or less but greater than 0 in combination with low temperature uniformity such that all of the available locations within the contents region volume of the dry ice shipper 1 are maintained at or below −60 degrees Celsius when 2 vol % to 50 vol % of the contents region volume 8 contains a predetermined amount of the dry ice 22, as determined under a condition when each of the one or more openings are substantially closed by an insulated cap 9. In another embodiment, the dry ice shipper 1 can have a normalized total heat channel seam length designated as $L_N$ which is 0.6 or less, but greater than 0, in combination with an overall heat transfer coefficient designated as U and having a value that is 1 kJ/hr/m$^2$/° C. or less, but greater than 0, wherein said value of the overall heat transfer coefficient (U) is determined under a condition where each of said one or more openings of the container is exposed to a surrounding environment. Generally speaking, any of the combination of embodiments described herein enable significantly better performance than typical with conventional dry ice shippers.

The significant improvement in performance of the inventive dry ice shippers over conventional shippers was demonstrated by inventors in the following tests. As labelled below, "Comparative Examples" are intended to designate tests that were performed for conventional shippers; whereas "Examples" are intended to designate tests that were performed for the inventive shippers. The conventional shippers designated as A, B, C, D, E and F are representative of the highest performing dry ice shippers available on the market and represent the benchmark industry standard. Shippers A and B were ThermoSafe EPS shippers (439 and 110LB4) that were manufactured by Sonoco Thermosafe; Shipper C was a KoolTemp insulated shipper (STS-U186-DIUL) that was manufactured by Cold Chain Technologies; and Shippers D, E and F were NanoCool insulated shippers (2-85430, 2-98630 and 2-1191030) that were manufactured by Pelicoan BioThermal, LLC. Table 1 hereinbelow indicates their respective dimensions and physical properties. Shippers A, B, C, D, E and F exhibited a range of insulation materials extending around their contents region volumes.

As a basis for comparison, five additional shippers were prepared in accordance with the present invention and are designated hereinbelow as V, W, X, Y and Z. The shippers had a range of sizes. Table 2 indicates the properties that the inventive shippers W, X, Y and Z were determined to exhibit as a result of the tests performed by inventors; the properties of shipper V are summarized in Example 17.

Comparative Examples 1-6 (U, R and $U_R$ with Conventional Shipper Closed to Surrounding Environment)

Each of conventional shippers A-F were tested to determine their respective overall heat transfer coefficients (U), loading ratios (R) and corresponding loading ratio overall heat transfer coefficients ($U_R$). Each shipper had a single opening into which 2 milliLiter (mL) cryovials and dry ice were introduced. Each cryovial was filled with 1.8 mL tap water. Prior to being loaded into shippers A-F, the cryovials were frozen to −79° C. over a 24-hour period to simulate storage of frozen perishable items in the shippers A-F. The quantity of cryovials and the additional packaging for the cryovials (e.g., bag or cryobox) used with each shipper A-F are listed in Table 1. Shippers A, B, C, E and F utilized cryoboxes which had dimensions of 5.25 inches in length by 5.25 inches in width by 2 inches in height. A single cryobox had a sufficient volume to hold 81 cryovials.

The specific packaging and amount of packaging employed depended on the dimensions of each shipper A-F. In this regard, the inventors loaded 1 cryobox into shippers A and E (i.e., a total of 81 cryovials); 3 cryoboxes into shipper B (i.e., a total of 243 cryovials); 2 cryoboxes into shipper F (i.e., a total of 162 cryovials); 5 cryoboxes into shipper C (a total of 405 cryovials); and 1 bag into shipper D (i.e., a total of 20 vials).

Having loaded a known quantity of cryoboxes or bags into shippers A-F, the volume occupied by said cryoboxes and bags were determined as shown by the values of $V_1$ in Table 1. Additionally, the contents region volume for each shipper A-F was determined by the length, width and height of the contents region listed in Table 1 for each of the shippers A-F. The difference between the contents region volume and $V_1$ equaled the amount of dry ice that was introduced into each shipper A-F ($V_D$).

Next, the loading ratios R for each of the shippers A-F were determined as $V_D/V_1$ as shown in equation (4). Table 1 shows the values of R ranged from 6.8 to 13.0 for shippers A-F.

Shippers A-F were closed with their accompanying insulated lids and then weighed approximately one hour after closing to allow sufficient time for the shipper and its contents to adequately equilibrate with the loaded dry ice. This first weight measurement represented the starting weight of the shippers A-F. The shippers A-F were left undisturbed in normal room conditions (20° C.) for approximately 24 additional hours, during which time the dry ice sublimated into carbon dioxide vapor, which was subsequently vented to the external atmosphere through gaps or passageways between the lid and opening, thereby preventing pressure buildup in the shippers A-F. After a duration of 24 hours, the presence of dry ice was confirmed to remain in each of the shippers A-F, and the shippers A-F were weighed to obtain a second weight measurement. The difference between the first and second weight measurements was the amount of dry ice that sublimated into carbon dioxide vapor during the 24 hour test period. The weight change divided by 24 hours represented the rate of sublimation as listed in Table 1 for each of shippers A-F.

The heat ingress, Q, into the shippers A-F was calculated by multiplying the sublimation rate of dry ice by the enthalpy of sublimation of dry ice (571 kJ/kg). During the 24 hour test period, the average temperature inside the contents region volume of shippers A-F was observed to be approximately equal to the normal sublimation temperature of dry ice (−78.5° C.), and the difference between the external temperature (20° C.) and internal temperature (−78.5° C.) was calculated. From the calculated heat ingress based on sublimation rate; the known internal surface area based on dimensions of the shippers A-F; and the difference between the external and internal temperatures, the overall heat transfer coefficient (U) was calculated using equation (3), shown hereinabove. The resulting values for the overall heat transfer coefficient (U) with shippers A-F in the closed state are shown in Table 1. The overall heat transfer coefficient (U) ranged from 0.91 to 1.87 kJ/hr/m$^2$/° C.

Equation (5) was then used to calculate the corresponding loading ratio overall heat transfer coefficient ($U_R$). The resulting values are shown in Table 1. The loading ratio overall heat transfer coefficients when the shippers A-F were closed ranged from 11.58 to 15.87 kJ/hr/m$^2$/° C.

Examples 1-4 (U, R and $U_R$ with Inventive Shippers Closed to Surrounding Environment)

Each of the inventive shippers W, X, Y and Z were tested to determine their respective overall heat transfer coefficients (U), loading ratios (R) and corresponding loading ratio overall heat transfer coefficients ($U_R$). Each shipper W, X, Y and Z had a single opening into which 2 milliLiter (ml) cryovials and dry ice were introduced. Similar to Comparative Examples 1-6, each cryovial was filled with 1.8 mL tap water. Prior to being loaded into shippers W-Z, the cryovials were frozen to −79° C. over a 24-hour period to simulate storage of frozen perishable items in the shippers W-Z. The quantity of cryovials and the additional packaging for the cryovials (e.g., bag, cane or cryobox) used with each shipper W-Z are also listed in Table 2. Shipper Z utilized cryoboxes which had dimensions of 5.25 inches in length by 5.25 inches in width by 2 inches in height with each cryobox capable of holding 81 cryovials. Shippers X and Y utilized canes, which is a standard vertically-oriented structure that is commonly utilized to hold biological specimens, with each cane capable of holding 5 cryovials. Shipper W utilized bags where each bag was able to store 10 vials.

The specific packaging and amount of packaging employed depended on the dimensions of each shipper W-Z. In this regard, inventors loaded 2 bags into shipper W (i.e., a total of 20 cryovials); 14 canes into shipper X (i.e., a total of 70 cryovials); 56 canes into shipper Y (i.e., a total of 280 cryovials); and 5 cryoboxes into shipper Z (i.e., a total of 405 cryovials).

Having loaded a known quantity of cryovials into bags, canes and cryoboxes for each of the shippers W-Z, respectively, the volume occupied by said bags, canes and cryoboxes were determined as shown by the values of $V_1$ in Table 2. Additionally, the contents region volume for each shipper W-Z was determined by the diameter and height of the contents region listed in Table 2 for each of the shippers W-Z. The difference between the contents region volume and $V_1$ equaled the amount of dry ice that was introduced into each shipper W-Z (designated as $V_D$).

Next, the loading ratios R were determined as $V_D/V_1$. Table 2 shows the values of R ranged from 0.9 to 3.6. These R values are significantly lower than those of conventional shippers A-F having R values that ranged 6.8 to 13.0. The smaller R values for shippers W-Z were indicative of the ability for the present invention to store more perishable items and less dry ice without compromising cooling duration.

Shippers W-Z were closed with a cap and then weighed approximately one hour after closing to allow sufficient time for the shipper and its contents to adequately equilibrate with the loaded dry ice. This first weight measurement represented the starting weight of the shippers W-Z. The shippers W-Z were left undisturbed in normal room conditions (20° C.) for approximately 24 additional hours, during which time the dry ice sublimated into carbon dioxide vapor, which was subsequently vented to the external atmosphere through a passageway between the plug of the cap and the shipper opening, thereby preventing pressure buildup in the shippers W-Z. After a duration of 24 hours, the presence of dry ice was confirmed to remain in each of the shippers A-F, and the shippers W-Z were weighed to obtain a second weight measurement. The difference between the first and second weight measurements was the amount of dry ice that sublimated into carbon dioxide vapor during the 24 hour test period. The weight change divided by 24 hours represented the rate of sublimation as listed in Table 2 for each of shippers W-Z.

The heat ingress, Q, into the shippers W-Z was calculated by multiplying the sublimation rate of dry ice by the enthalpy of sublimation of dry ice (571 kJ/kg). During the 24 hour test period, the average temperature inside the contents region volume of shippers W-Z was observed to be approximately equal to the normal sublimation temperature of dry ice (−78.5° C.), and the difference between the external temperature (20° C.) and internal temperature (−78.5° C.) was calculated. From the calculated heat ingress based on sublimation rate; the known internal surface area based on dimensions of the shippers W-Z; and the difference between the external and internal temperatures, the overall heat transfer coefficient (U) was calculated using equation (3), shown hereinabove. The resulting values for the overall heat transfer coefficient (U) with shippers W-Z in the closed state are shown in Table 2. The overall heat transfer coefficient (U) ranged from 0.16 to 0.28 kJ/hr/m$^2$/° C., which was significantly lower than U for conventional shippers A-F, which ranged from 0.91 to 1.87 kJ/hr/m$^2$/° C. The lower U validated the ability for the present invention to maintain better cooling duration than conventional shippers A-F.

The corresponding loading ratio overall heat transfer coefficient ($U_R$), which is the multiplicative product of U and R, was calculated using equation (5). The calculated values are shown in Table 2. The loading ratio overall heat transfer coefficients ($U_R$) when the shippers W-Z were in the closed state ranged from 0.15 to 0.67 kJ/hr/m$^2$/° C., which was orders of magnitude lower than conventional shippers A-F, which ranged from 11.58 to 15.87 kJ/hr/m$^2$/° C. The lower $U_R$ for inventive shippers W-Z was a key performance parameter that was indicative of extended cooling duration while maintaining the ability to store a sufficient amount of perishable items with relatively less dry ice in comparison to conventional shippers (as represented by the tests of Comparative Examples 1-6).

Comparative Examples 7-12 (U, R and $U_R$ with Conventional Shippers Open to Surrounding Environment)

Each of conventional shippers A-F were tested to determine their respective overall heat transfer coefficients (U), loading ratios (R) and corresponding loading ratio overall heat transfer coefficients ($U_R$) with the shippers A-F in the open condition, which represents a worst-case scenario under which the performance of the shippers A-F were intended to be evaluated. The open condition was defined as the corresponding insulated lid removed from each of shippers A-F so that the single opening of the shippers A-F was exposed to the surrounding environment.

With the exception of removal of the insulated lid from the single opening of each of shippers A-F, the remainder of the test procedure was substantially similar to that described in Comparative Examples 1-6 and Examples 1-4.

Dry ice was loaded into shippers A-F to fill the volume $V_D$, and then the insulated lid was inserted into the single opening of each shipper A-F to close the shipper. The shippers A-F were maintained closed for one hour and then weighed. This first weight represented the starting weight of the shippers A-F. Next, the insulated lid for each of shippers A-F was removed from its respective opening.

The open shippers A-F were left undisturbed in normal room conditions (20° C.) for approximately 24 additional hours, during which time the dry ice sublimated into carbon dioxide vapor, which subsequently freely flowed out through the corresponding opening of the shippers A-F. Because the shippers A-F were open and exposed to the surrounding environment, the internal temperatures (i.e., temperatures for the contents region volume) for the shippers A-F were observed to not be substantially equal to the normal sublimation temperature of dry ice (−78.5° C.) over the 24 hours. Consequently, the internal temperature was approximated as the average of the normal sublimation temperature of dry ice and the warmest temperature that was measured in the contents region volume of the shippers A-F at the 24 hour time point. For all of the shippers A-F, the inventors observed that the warmest temperature in the contents region volume was always measured in the area located near the top thereof in close proximity to the respective openings of shippers A-F. The temperature values measured at the 24 hour time point were recorded and are listed in Table 1.

After a duration of 24 hours, the presence of dry ice was confirmed to remain in each of the shippers A-F. The shippers A-F were weighed again to obtain a second weight measurement. The difference between the first and second weight measurements was the amount of dry ice that sublimated into the carbon dioxide vapor during the 24 hour test period. The weight change divided by 24 hours represented the rate of sublimation while the shippers A-F were open as listed in Table 1.

The heat ingress (Q) into the shippers A-F was calculated by multiplying the sublimation rate of dry ice by the enthalpy of sublimation of dry ice (571 kJ/kg). The difference between the internal temperature, using the approximation for the internal temperature as described hereinabove and listed in Table 1, and the external temperature (20° C.) was calculated. From the calculated heat ingress (Q) based on sublimation rate; the known internal surface area based on dimensions of the shippers A-F; and the difference between the external and internal temperatures, the overall heat transfer coefficients (U) with shippers A-F open were calculated and are shown in Table 1. The overall heat transfer coefficient (U) ranged from 3.32 to 4.90 kJ/hr/m$^2$/° C. Utilizing the R values that were determined in Comparative Examples 1-6, the loading ratio overall heat transfer coefficients ($U_R$) were calculated and are shown in Table 1 to range from to 30.8 to 62.4 kJ/hr/m$^2$/° C.

Examples 5-8 (U, R and $U_R$ with Inventive Shippers Open to Surrounding Environment)

Each of inventive shippers W-Z were tested to determine their respective overall heat transfer coefficients (U), loading ratios (R) and corresponding loading ratio overall heat transfer coefficients ($U_R$) with the shippers W-Z in the open condition. The test procedure was identical to that described in Comparative Example 7-12. The overall heat transfer coefficients (U) with shippers W-Z open were calculated and are shown in Table 2. The overall heat transfer coefficient (U) ranged from 0.31 to 0.82 kJ/hr/m$^2$/° C., which was significantly lower than U for conventional shippers A-F which ranged from 3.32 to 4.90 kJ/hr/m$^2$/° C. The lower U for the present invention in which the shippers W-Z are directly exposed to the surrounding environment serves to reinforce the ability of the present invention to perform significantly better under worst-case conditions where conventional shippers A-F exhibited inferior performance.

Utilizing the R values that were determined in Examples 1-4, the loading ratio overall heat transfer coefficients ($U_R$) were calculated and are shown in Table 2 to range from to 0.75 to 1.29 kJ/hr/m$^2$/° C., which also were significantly lower than the loading ratio overall heat transfer coefficients ($U_R$) for conventional shippers A-F, which range from to 30.8 to 62.4 kJ/hr/m$^2$/° C. The increase in absolute values of U and $U_R$ between the closed state and open state for inventive shippers W-Z was not as dramatic as was observed with conventional shippers A-F.

Comparative Examples 13-18 (Seam Lengths and Normalized Loading Ratio Heat Channel Factor for Conventional Shippers)

Each of conventional shippers A-F were characterized according to their seam lengths. First, the total insulation heat channel seam lengths ($L_{ins}$) were determined. The insulation heat channel seams occur where two insulating panels or walls are joined together on a side of the shippers. The inventors noted that each of shippers A, B and C did not have insulation heat channel seams, meaning there was no discontinuity in the insulating walls. Shippers D, E and F were measured to have total insulation heat channel seam lengths of 1.1 m; 1.57 m; and 2.08 m, respectively, as shown in Table 1.

Next, the total opening heat channel seam lengths ($L_{open}$) were determined. The opening heat channel seams occur along the perimeters of the shipper openings. For each of shippers A-F, the total opening heat channel seam lengths were measured to be 0.71 m, 1.22 m, 1.65 m, 0.67 m, 0.90 m and 1.03 m, respectively, as listed in Table 1.

Next, the total heat channel seam length $L_T$ (in units of m) for shippers A-F were calculated as the sum of the total insulation heat channel seam lengths ($L_{ins}$) and total opening heat channel seam lengths ($L_{open}$). The values are listed in Table 1.

To provide meaningful heat channel seam length measurements that could be compared with other shippers irrespective of their size, the total heat channel seam length $L_T$ was converted to a normalized value by dividing by $L_S$, which represents the sum of the three major external dimensions of a particular shipper. Here, all the shippers were rectangular in shape and therefore the sum of the maximum length, width and height produced the $L_S$ value for each of shippers A-F. $L_T$ divided by $L_S$ produced the normalized total heat channel seam length, designated as $L_N$ (equation 2) and listed in Table 1.

Having determined $L_N$ and R, the key design characteristic called the normalized loading ratio heat channel factor (F) was calculated based on equation (6). The results are listed in Table 1.

Examples 9-12 (Seam Lengths and Normalized Loading Ratio Heat Channel Factor for Inventive Shippers)

Each of inventive shippers W-Z were characterized according to their seam lengths. First, the total insulation heat channel seam lengths ($L_{ins}$) were determined. The insulation heat channel seams occur where two insulating panels or walls are joined together on a side of the shippers. The inventors noted that each of shippers W, X, Y and Z did not have insulation heat channel seams, meaning there was no discontinuity in the insulating walls. Hence, Table 2 shows that $L_{ins}=0$ for each shipper W-Z.

Next, the total opening heat channel seam lengths ($L_{open}$) were determined. The opening heat channel seams occur along the perimeters of the shipper openings. For each of shippers W-Z, the total opening heat channel seam lengths were measured to be the circumference of its opening, which was 0.28 m, 0.28 m, 0.48 m, and 0.68 m, respectively, as listed in Table 2.

Next, the total heat channel seam length $L_T$ (in units of m) for shippers W-Z were calculated as the sum of the total insulation heat channel seam lengths ($L_{ins}$) and total opening heat channel seam lengths ($L_{open}$). The values are listed in Table 2.

To provide meaningful heat channel seam length measurements that could be compared with other shippers irrespective of their size, the total heat channel seam length $L_T$ was converted to a normalized value by dividing by $L_S$, which represents the sum of the three major external dimensions of a particular shipper. Here, all the shippers W-Z were cylindrical in shape, and therefore the maximum external dimensions were the maximum diameter and its maximum height. To be consistent with the usage of three external dimensions for the $L_S$ calculation that was obtained for shippers A-F that were rectangular in shape, the $L_S$ value for the cylindrically-shaped shippers W-Z was equal to the maximum diameter+maximum diameter+maximum height. $L_T$ divided by $L_S$ produced the normalized total heat channel seam length, designated as $L_N$ (equation 2) and listed in Table 2. A comparison of Table 2 with Table 1 shows that the normalized total heat channel seam lengths ($L_N$) for the inventive shippers W-Z having values ranging from 0.30 to 0.54 were significantly less than those of conventional shippers A-F having values ranging from 0.84 to 2.97.

Having determined $L_N$ and R, the key design characteristic called the normalized loading ratio heat channel factor (F) was calculated for the inventive shippers W-Z based on equation (6). The results are listed in Table 2. A comparison of Table 2 with Table 1 shows that the normalized loading ratio heat channel factors (F) for the inventive shippers W-Z having values ranging from 0.50 to 1.06 were significantly less than those of conventional shippers A-F having values ranging from 5.72 to 34.05. In summary, the lower F and $L_N$ parameters for the present invention in comparison to the conventional shippers A-F are indicative of heat channel characteristics that produce a more efficient and better performing shipper without having to introduce more dry ice or reduce the payload volume.

Comparative Examples 19-24 (FIG. 3, FIG. 5 and FIG. 7)

Each of conventional shippers A-F were tested to determine the warmest temperature in the contents region volume and the ability of the shippers to maintain temperature uniformity as a function of the percentage of dry ice remaining inside the shipper. After completion of the tests described hereinabove to determine respective overall heat transfer coefficients (Comparative Examples 1-6 and 7-12), the cryovials, canes and bags corresponding to conventional shippers A-F were allowed to remain inside the conventional dry ice shippers, and the shippers were subsequently refilled with dry ice and closed. A T-type thermocouple was placed inside the contents region volume at the underside of the lid in each shipper. This location provided the warmest temperature measured in the contents region volume (hereinafter, also referred to as "the warmest temperature"). In this manner, the warmest temperature was measured and monitored as each shipper was left undisturbed in normal room conditions (20° C.) and dry ice underwent sublimation. Additionally, the weight of each of the shippers (A-F) was measured to determine the amount of dry ice remaining after on-going sublimation inside the shipper and the corresponding percentage of the shipper's contents region volume occupied with dry ice.

The resulting performance data was plotted in FIGS. 3, 5 and 7 for the shippers A-F. In each case, the horizontal axis is the percentage of the shipper's contents region volume containing dry ice, and the starting measurements for the percentage of the shipper's contents region volume containing dry ice were less than 100 vol % because the items within cryovials, canes or bags occupied a portion of the contents region volume.

FIG. 3 shows the warmest temperature measured inside the shipper's contents region volume on the vertical axis as a function of the percentage of the shipper's contents region volume containing dry ice. FIG. 5 shows the average rate of change of the warmest temperature inside the shipper's contents region volume calculated from the data in FIG. 3.

The coldest region of the shipper occurs at the surface of the dry ice, and its temperature was approximated to be the normal sublimation temperature of dry ice of −78.5° C. Using the data from FIG. 3, the difference between the warmest temperature measured in the shipper's contents region volume and the normal sublimation temperature of dry ice (−78.5° C.) was calculated and plotted on the vertical axis of FIG. 7. Subcooling effects of dry ice were not required to be taken into consideration to obtain a reasonable estimation of the maximum temperature difference inside the shipper for purposes of comparison with other shippers. Generally speaking, all shippers A-F exhibited unsatisfactory temperature uniformity as evident by the large temperature differences between the temperatures measured in the warmest and coldest areas of each shipper's contents region volume.

Examples 13-16 (FIG. 4, FIG. 6, FIG. 8, FIG. 9 and FIG. 10)

Each of inventive shippers W-Z were tested in the exact same manner and under identical conditions as described with respect to Comparative Examples 19-24 to ensure a proper comparison of the conventional and inventive shippers could be made. A T-type thermocouple was placed inside the contents region volume at the underside of the cap's plug in each of said inventive shippers W-Z. This location provided the warmest temperature. In this manner, the warmest temperature was measured and monitored as each shipper was left undisturbed in normal room conditions (20° C.) and dry ice underwent sublimation. Weight measurements were also taken to determine the amount of dry ice remaining after on-going sublimation inside the shipper and the corresponding percentage of the shipper's contents region volume occupied with dry ice. The resulting performance data was plotted in FIGS. 4, 6 and 8.

FIG. 4 clearly shows that the minimum percentage of the contents region volume containing dry ice necessary to maintain all locations in the contents region volume of the inventive shippers W-Z below −70° C. ranged from approximately 2 vol % to 8 vol %. Additionally, all locations in the contents region volumes for shippers W-Z had temperatures below −60° C. in the presence of as little as 2 vol % of the contents region volume occupied by dry ice. By contrast, FIG. 3 shows that several of the conventional shippers A-F were not able to maintain all locations in their respective contents region volume below −70° C. even if more than 70 vol % of the contents region volume contained dry ice.

Additionally, FIG. 6 shows the inventive shippers W-Z exhibited resistance to change in the warmest temperature of the shipper contents region volume as dry ice sublimated and was reduced in amount within the contents region volume. As dry ice sublimated in the contents region volume of the dry ice shipper from about 80 vol % to about 10 vol % of the contents region volume occupied, the warmest temperature of the inventive shippers W-Z remained relatively constant, only exhibiting an average rate of change of the warmest temperature between 0 and 0.03° C./%, which is a significant improvement in performance over the conventional shippers A-F as shown in FIG. 5 in connection with Comparative Examples 19-24.

Figure 9:
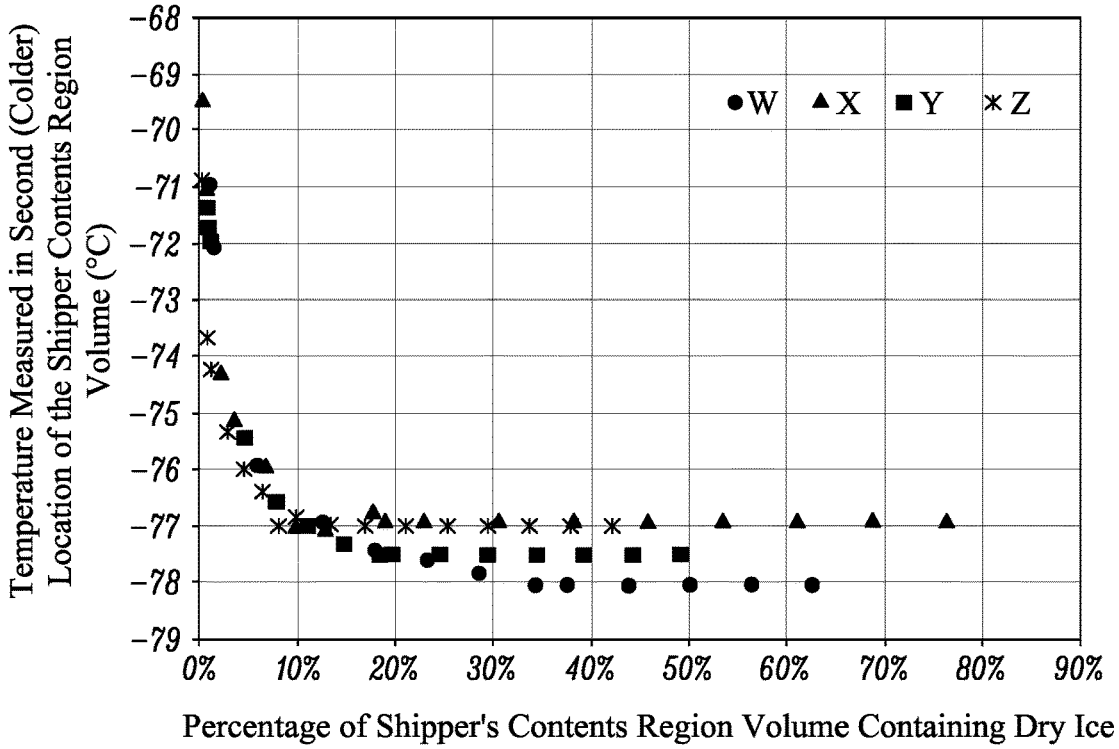
FIG. 9 illustrates a graphical display of the temperature measured at a second (colder) location than where the warmest temperature was measured inside a dry ice shipper of the present invention as a function of the percentage of the contents region volume containing dry ice.

The average resistance to change in the measured temperature of any location within the contents region volume of the dry ice shipper as dry ice sublimated (i.e., average rate of change of the temperature of any location) was determined to be similar in behavior to the average resistance to change in the measured temperature of the warmest location of the dry ice shipper as dry ice sublimated (i.e., average rate of change of the warmest temperature). This observation was demonstrated by the following procedure. The T-type thermocouple was relocated from the warmest location to a second (colder) location within the contents region volume of each of the inventive shippers W-Z. The temperature of this second location was measured and monitored as each shipper was left undisturbed in normal room conditions (20° C.) and the dry ice underwent sublimation. Weight measurements were also periodically taken to determine the amount of dry ice remaining after on-going sublimation inside the shipper and the corresponding percentage of the shipper's contents region volume occupied with dry ice. The resulting performance data was plotted in FIGS. 9 and 10. FIG. 9 shows the temperature measured at the second (colder) location inside the shipper's contents region volume on the vertical axis as a function of the percentage of the shipper's contents region volume containing dry ice. Comparison of FIGS. 4 and 9 confirmed that the temperature measured in the second (colder) location was consistently colder than the temperature measured in the warmest location for all amounts of dry ice remaining in the contents region volume of the inventive shippers W-Z.

Based on the data of FIG. 9, the average rate of change of the temperature measured at the second (colder) location inside the shipper's contents region volume was calculated at specific values of the percentage of the contents region volume containing dry ice for inventive shippers W-Z (henceforth, referred to by abbreviation as the "average rate of change of the temperature of the second (colder) location"). First, the temperature difference of (g) minus (h) was determined, where (g) was the temperature of the second (colder) location when the portion of the contents region volume for holding dry ice was maximally loaded (with the remainder of the contents region volume holding the perishable items) and (h) was the temperature of the second (colder) location as dry ice sublimated and was reduced from the maximally loaded amount to a specific value of the percentage of the contents region volume containing dry ice. Next, the temperature difference of (g) minus (h) was divided by the difference in values of the percentage of the contents region volume containing dry ice of (i) minus (j), where (i) corresponded to the percentage of the contents region volume containing the maximal amount of dry ice at (g); and (j) corresponded to the percentage of the contents region volume containing dry ice after sublimation to produce (h). The average rate of change of the temperature of the second (colder) location is shown in FIG. 10. A comparison of FIGS. 6 and 10 illustrates that the average rate of change of the temperature in the second (colder) location within the contents region volume of a dry ice shipper was similar to the average rate of change of the warmest temperature for the inventive shippers. Hence, the inventive shippers W-Z were determined to exhibit an average rate of change of the temperature of any location in the contents region volume between 0 and 0.03° C./%, when dry ice sublimates and is reduced in the contents region volume from an initial amount occupying up to about 80 vol % to a final amount occupying a percentage of the contents region volume 8 less than the initial amount and no less than about 10 vol % of the contents region volume 8.

Analogous to Comparative Examples 19-24, the coldest region of the inventive shippers W-Z was approximated to be the normal sublimation temperature of dry ice of −78.5° C. Using the data from FIG. 4, the difference between the warmest temperature measured in the shipper's contents region volume and the normal sublimation temperature of dry ice (−78.5° C.) was calculated and plotted on the vertical axis of FIG. 8. Subcooling effects of dry ice were not required to be taken into consideration to obtain a reasonable estimation of the maximum temperature difference inside the shipper for purposes of comparison with other shippers. A comparison of FIG. 8 with FIG. 7, generated from the tests of Comparative Examples 19-24, shows the notable differences in uniformity of the temperature of the contents region volume between the inventive shippers W-Z and the conventional shippers A-F. Conventional shippers A-F had much larger differences between the temperatures measured in the warmest area of each shipper's contents region and the normal sublimation temperature of dry ice. In contrast, FIG. 8 shows that the temperature difference for the inventive dry ice shippers W-Z was less than 8° C. as long as at least 10 vol % of the contents region volume was occupied with dry ice, and the temperature difference was less than 10° C. as long as at least 5 vol % of the contents region volume was occupied with dry ice. In contrast, few of the conventional shippers A-F were able to maintain a temperature difference of 10° C., and those shippers that were able to achieve the temperature difference of 10° C. required at least 70 vol % of the contents region volume to contain dry ice. The ability for the inventive shippers to maintain sufficient temperature uniformity with as little as 5 vol % of dry ice is a significant performance improvement not possible with existing dry ice shippers.

Example 17

A different inventive shipper V was tested to determine its respective overall heat transfer coefficients (U) and loading ratio overall heat transfer coefficients ($U_R$) in the open and closed condition. Shipper V had a cylindrically-shaped contents region volume with diameter of 17.4 cm, height of 28.8 cm, and volume of 6.9 Liters. The total internal surface area of shipper V was 0.20 $m^2$. Shipper V had a single opening into which 2 milliLiter (mL) cryovials and dry ice were introduced. Prior to being loaded into shipper V, each cryovial was filled with 1.8 mL tap water and frozen to −79° C. over a 24-hour period to simulate storage of frozen perishable items in shipper V. A total of 70 cryovials were loaded into shipper V with 5 cryovials loaded onto each of 14 canes. The volume occupied by the canes represents the portion of shipper V's contents region volume allocated to items ($V_1$) and was determined to be 1.5 Liters. The difference between the contents region volume and $V_1$ equaled 5.4 Liters and was the amount of dry ice that was introduced into shipper V (designated as $V_D$). The loading ratio R was therefore 3.6.

For the closed condition test, shipper V was closed with a cap and then weighed approximately one hour after closing to allow sufficient time for the shipper and its contents to adequately equilibrate with the loaded dry ice. This first weight measurement represented the starting weight of shipper V. The shipper was left undisturbed in normal room conditions (20° C.) for approximately 24 additional hours, during which time a portion of the dry ice sublimated into carbon dioxide vapor. Shipper V was then weighed again to obtain a second weight measurement. The sublimation rate of dry ice in shipper V in the closed condition during the 24 hour test period was calculated from the first and second weight measurements to be 0.018 kg/hr.

For the open condition test, shipper V was refilled with dry ice, and the cap was inserted into the single opening of shipper V. Shipper V was weighed approximately one hour after filling the dry ice to obtain a first weight measurement. The cap was removed, and shipper V was left undisturbed in normal room conditions (20° C.) for approximately 24 additional hours. Shipper V was weighed again to obtain a second weight measurement. The sublimation rate of dry ice in shipper V in the open condition during the 24 hour test period was calculated from the first and second weight measurements to be 0.033 kg/hr.

Following the same procedures described in Examples 1-4 and 5-8, the overall heat transfer coefficients (U) were calculated using equation (3) to be 0.51 kJ/hr/$m^2$/° C. in the closed condition and 0.93 kJ/hr/$m^2$/° C. in the open condition. The corresponding loading ratio overall heat transfer coefficients ($U_R$) were calculated using equation (5) to be 1.84 kJ/hr/$m^2$/° C. in the closed condition and 3.35 kJ/hr/$m^2$/° C. in the open condition. Although the loading ratio overall heat transfer coefficients for inventive shipper V both in the closed and open condition were greater than the $U_R$ values determined for inventive shippers W-Z, they remained much less than the respective values for conventional shippers A-F.

TABLE 1

| Shipper | A | B | C | D | E | F |
|---|---|---|---|---|---|---|
| Contents Region Length (cm) | 20.3 | 30.5 | 45.7 | 21.6 | 23.6 | 28.7 |
| Contents Region Width (cm) | 15.2 | 30.5 | 36.8 | 11.7 | 21.6 | 22.6 |
| Contents Region Height (cm) | 22.9 | 31.8 | 41.9 | 10.9 | 16.8 | 26.4 |
| Internal Surface Area ($m^2$) | 0.22 | 0.57 | 0.86 | 0.12 | 0.25 | 0.40 |
| Number of 2 mL Cryovials | 81 | 243 | 405 | 20 | 81 | 162 |
| Cryovial Packaging | 1 cryobox[1] 81 vials/box | 3 cryoboxes[1] 81 vials/box | 5 cryoboxes[1] 81 vials/box | 1 bag 20 vials/bag | 1 cryobox[1] 81 vials/box | 2 cryoboxes[1] 81 vials/box |
| $V_I$ (Liters) | 0.9 | 2.7 | 4.5 | 0.2 | 0.9 | 1.8 |
| $V_D$ (Liters) | 6.2 | 26.8 | 49.0 | 2.6 | 7.3 | 15.3 |
| Loading Ratio R | 6.8 | 9.9 | 10.8 | 13.0 | 8.1 | 8.5 |
| Wall Insulation | Polystyrene Foam | Polystyrene Foam | Polyurethane Foam | Vacuum-Insulated Panels | Vacuum-Insulated Panels | Vacuum-Insulated Panels |
| Dry Ice Sublimation Rate when Closed (kg/hr) | 0.065 | 0.134 | 0.160 | 0.019 | 0.074 | 0.129 |
| Overall Heat Transfer Coefficient when Closed (kJ/hr/m2/° C.) | 1.69 | 1.36 | 1.08 | 0.91 | 1.70 | 1.87 |
| Loading Ratio Overall Heat Transfer Coefficient when Closed (kJ/hr/m2/° C.) | 11.58 | 13.43 | 11.74 | 11.88 | 13.76 | 15.87 |
| Dry Ice Sublimation Rate when Open (kg/hr) | 0.115 | 0.238 | 0.354 | 0.060 | 0.100 | 0.162 |
| Warmest Internal Temperature after 24 hours when Open (° C.) | −11.10 | 0.97 | −22.73 | 2.23 | −2.64 | 3.68 |
| Overall Heat Transfer Coefficient when Open (kJ/hr/m2/° C.) | 4.50 | 4.04 | 3.32 | 4.80 | 4.90 | 4.02 |

TABLE 1-continued

| Shipper | A | B | C | D | E | F |
|---|---|---|---|---|---|---|
| Loading Ratio | 30.8 | 40.0 | 36.0 | 62.4 | 39.6 | 34.1 |
| Overall Heat Transfer Coefficient when Open (kJ/hr/m2/° C.) | | | | | | |
| Exterior Shipper Length (cm) | 29.2 | 40.6 | 57.2 | 28.7 | 31.2 | 35.6 |
| Exterior Shipper Width (cm) | 24.1 | 41.9 | 47.0 | 19.8 | 29.2 | 32.8 |
| Exterior Shipper Height (cm) | 31.8 | 41.9 | 48.3 | 19.1 | 25.4 | 36.3 |
| $L_{ins}$ (m) | 0 | 0 | 0 | 1.1 | 1.57 | 2.08 |
| $L_{open}$ (m) | 0.71 | 1.22 | 1.65 | 0.67 | 0.90 | 1.03 |
| $L_N$ | 0.84 | 1.23 | 1.33 | 2.62 | 2.89 | 2.97 |
| F | 5.72 | 12.17 | 14.38 | 34.05 | 23.32 | 25.22 |

[1]Cryobox dimensions are 5.25 inch length × 5.25 inch width × 2 inch height.

TABLE 2

| Shipper | W | X | Y | Z |
|---|---|---|---|---|
| Contents region diameter (cm) | 14.9 | 17.4 | 20.8 | 27.8 |
| Contents region height (cm) | 17.4 | 28.8 | 28.1 | 31.7 |
| Internal Surface Area ($m^2$) | 0.12 | 0.20 | 0.25 | 0.40 |
| Number of 2 mL Cryovials | 20 | 70 | 280 | 405 |
| Cryovial Packaging | 2 bags 10 vials/bag | 14 canes 5 vials/cane | 56 canes 5 vials/cane | 5 cryoboxes 81 vials/box |
| $V_I$ (Liters) | 0.9 | 1.5 | 4.4 | 10.0 |
| $V_D$ (Liters) | 2.1 | 5.4 | 5.2 | 9.2 |
| Loading Ratio R | 2.4 | 3.6 | 1.2 | 0.9 |
| Wall Insulation | Vacuum-Insulated Wall | Vacuum-Insulated Wall | Vacuum-Insulated Wall | Vacuum-Insulated Wall |
| Dry Ice Sublimation Rate when Closed (kg/hr) | 0.006 | 0.006 | 0.009 | 0.011 |
| Overall Heat Transfer Coefficient when Closed (kJ/hr/m2/° C.) | 0.28 | 0.16 | 0.21 | 0.17 |
| Loading Ratio Overall Heat Transfer Coefficient when Closed (kJ/hr/m2/° C.) | 0.67 | 0.58 | 0.24 | 0.15 |
| Dry Ice Sublimation Rate when Open (kg/hr) | 0.011 | 0.011 | 0.026 | 0.053 |
| Warmest Internal Temperature after 24 hours when Open (° C.) | −72.9 | −74.7 | −61.9 | −68.6 |
| Overall Heat Transfer Coefficient when Open (kJ/hr/m2/° C.) | 0.54 | 0.31 | 0.67 | 0.82 |
| Loading Ratio Overall Heat Transfer Coefficient when Open (kJ/hr/m2/° C.) | 1.29 | 1.09 | 0.78 | 0.75 |
| Exterior shipper diameter (cm) | 19.5 | 22.3 | 26.1 | 35.4 |
| Exterior shipper height (cm) | 33.5 | 50.1 | 50.4 | 53.2 |
| $L_{ins}$ (m) | 0 | 0 | 0 | 0 |
| $L_{open}$ (m) | 0.28 | 0.28 | 0.48 | 0.68 |
| $L_N$ | 0.39 | 0.30 | 0.47 | 0.54 |
| F | 0.92 | 1.06 | 0.54 | 0.50 |

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. An improved dry ice containing apparatus, comprising:

a transportable shipper with a contents region volume, said contents region volume at least partially defined by shipper walls surrounding therealong, said contents region volume apportioned between a first portion for holding dry ice and a second portion for holding one or more perishable items;

the dry ice occupying the first portion of the contents region volume;

the one or more perishable items occupying the second portion of the contents region volume;

one or more openings extending into the shipper walls, each of said one or more openings in fluid communication with the contents region volume to allow dry ice and the one or more perishable items to be introduced thereinto and removed therefrom;

one or more corresponding insulated plugs to substantially close the one or more openings;

the improved dry ice containing apparatus comprising an insulative structural element, said insulative structural element encapsulating the contents region volume and configured to reduce heat ingress from a surrounding environment into the contents region volume to create a loading ratio overall heat transfer coefficient designated as ($U_R$) and having a value that is less than about 2 kJ/hr/m$^2$/° C., but greater than 0, wherein the loading ratio overall heat transfer coefficient ($U_R$) is determined under a condition where each of the one or more openings is substantially closed by the one or more corresponding insulated plugs.

2. The improved dry ice containing apparatus of claim 1, wherein the loading ratio overall heat transfer coefficient ($U_R$) is 1.85 kJ/hr/m$^2$/° C. or less, but greater than 0, wherein the loading ratio overall heat transfer coefficient ($U_R$) is determined under the condition where each of the one or more openings is substantially closed by the one or more corresponding insulated plugs.

3. An improved dry ice containing apparatus, comprising:

a transportable shipper with a contents region volume, said contents region volume surrounded by insulative shipper walls;

wherein the contents region volume contains all of the available locations for placement of dry ice and one or more perishable items;

the dry ice occupying a portion of the contents region volume;

one or more openings in the surrounding insulative shipper walls through which (i) the dry ice can be loaded into and removed from the contents region volume, and (ii) the one or more perishable items can be loaded into or removed from the contents region volume;

one or more corresponding insulated plugs to substantially close off the one or more openings;

wherein the improved dry ice containing apparatus is configured to maintain all of the available locations within the contents region volume at or below −70 degrees Celsius when 10-70 vol % of the contents region volume contains the dry ice, as determined under a condition when each of the one or more openings are substantially closed by the one or more corresponding insulated plugs.

4. The improved dry ice containing apparatus of claim 3, wherein the contents region volume is maintained at or below −70 degrees Celsius when 10-60 vol % of the contents region volume contains the dry ice.

5. The improved dry ice containing apparatus of claim 3, wherein the contents region volume is maintained at or below −70 degrees Celsius when 10-50 vol % of the contents region volume contains the dry ice.

6. The improved dry ice containing apparatus of claim 3, wherein the contents region volume is maintained at or below −70 degrees Celsius when 10-40 vol % of the contents region volume contains the dry ice.

7. The improved dry ice containing apparatus of claim 3, wherein the contents region volume is maintained at or below −70 degrees Celsius when 10-30 vol % of the contents region volume contains the dry ice.

8. The improved dry ice containing apparatus of claim 3, wherein the contents region volume is maintained at or below −70 degrees Celsius when 10-20 vol % of the contents region volume contains the dry ice.

9. The improved dry ice containing apparatus of claim 3, said apparatus adapted to exhibit an average rate of change of the temperature of any location in the contents region volume between zero and 0.05° C./% as dry ice sublimates and is reduced in the contents region volume of the dry ice shipper from an initial amount occupying up to about 80 vol % of the contents region volume to a final amount occupying a percentage of the contents region volume less than the initial amount and no less than about 10 vol % of the contents region volume.

10. The improved dry ice containing apparatus of claim 3, wherein the contents region volume is maintained at or below −70 degrees Celsius when at least 10 vol % of the contents region volume contains the dry ice.

* * * * *